US008764920B2

(12) United States Patent
Lin et al.

(10) Patent No.: US 8,764,920 B2
(45) Date of Patent: Jul. 1, 2014

(54) ALUMINUM-COPPER ALLOYS CONTAINING VANADIUM

(75) Inventors: Jen C. Lin, Export, PA (US); Ralph R. Sawtell, Gibsonia, PA (US); Gary H. Bray, Murrysville, PA (US); Cindie Giummarra, Edina, MN (US); Andre Wilson, Delmont, PA (US); Gregory B. Venema, Bettendorf, IA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 13/610,755

(22) Filed: Sep. 11, 2012

(65) Prior Publication Data

US 2014/0137995 A1 May 22, 2014

Related U.S. Application Data

(63) Continuation of application No. 12/692,508, filed on Jan. 22, 2010, now Pat. No. 8,287,668.

(60) Provisional application No. 61/146,585, filed on Jan. 22, 2009.

(51) Int. Cl.
*C22F 1/057* (2006.01)

(52) U.S. Cl.
USPC ..... 148/694; 148/700; 148/691; 148/693

(58) Field of Classification Search
USPC ..... 148/690, 693, 694, 698–700
See application file for complete search history.

(56) References Cited

U.S. PATENT DOCUMENTS 7,323,068 B2 * 1/2008 Benedictus et al. ..... 148/417
2006/0011272 A1 * 1/2006 Lin et al. ..... 148/439

OTHER PUBLICATIONS

Kurdyumov, A.V., et al., "Production of castings for nonferrous metal alloys," a textbook for technical colleges, Moscow: *Metallurgiya*, 1986, pp. 134, 135 (with English translation).

* cited by examiner

*Primary Examiner* — Roy King
*Assistant Examiner* — Janelle Morillo
(74) *Attorney, Agent, or Firm* — Greenberg Traurig, LLP

(57) ABSTRACT

New 2xxx aluminum alloys containing vanadium are disclosed. In one embodiment, the aluminum alloy includes 3.3-4.1 wt. % Cu, 0.7-1.3 wt. % Mg, 0.01-0.16 wt. % V, 0.05-0.6 wt. % Mn, 0.01 to 0.4 wt. % of at least one grain structure control element, the balance being aluminum, incidental elements and impurities. The new alloys may realize an improved combination of properties, such as in the T39 or T89 tempers.

20 Claims, 11 Drawing Sheets

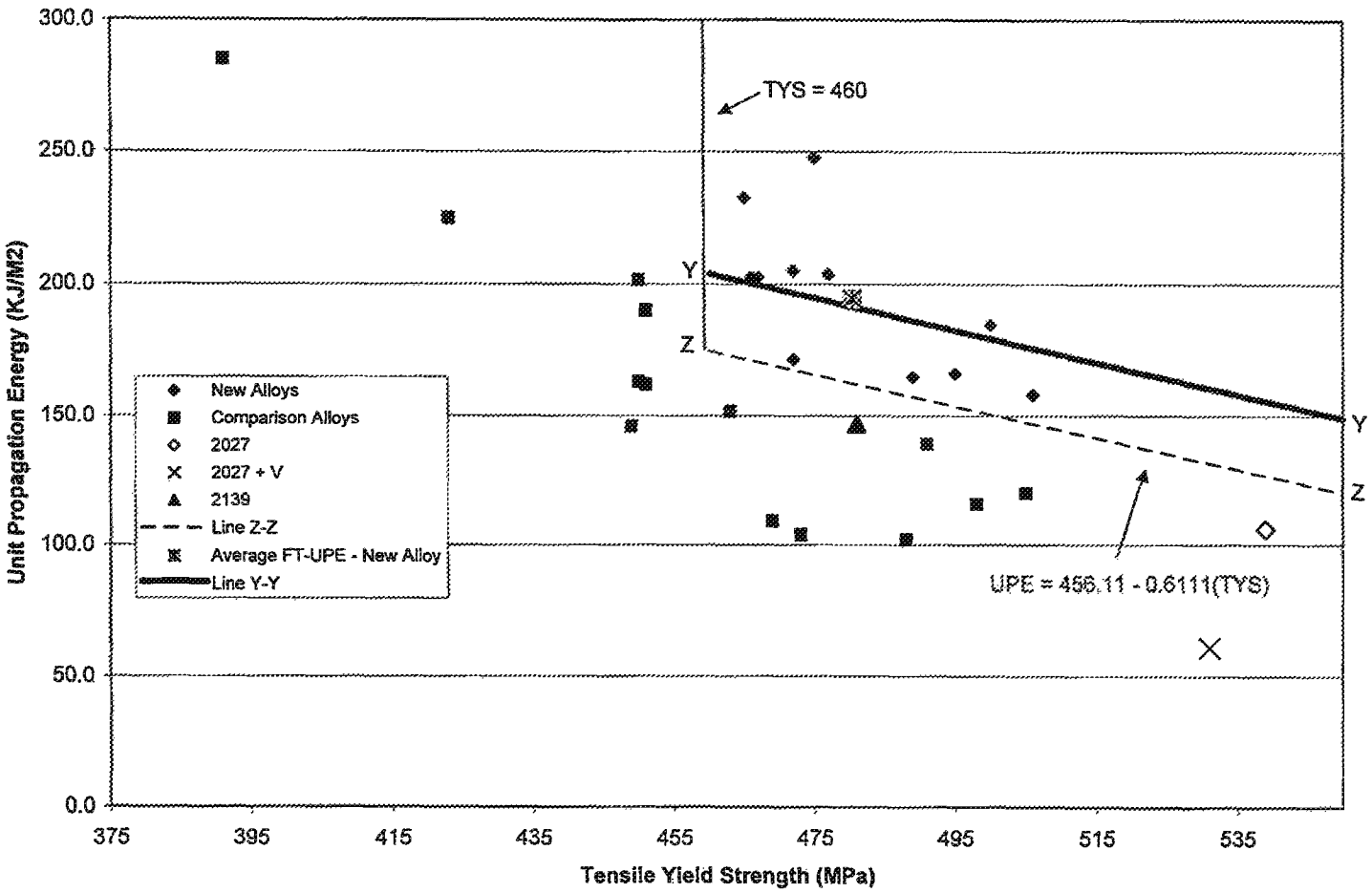
FIG. 1 - 2XXX + V
Strength v. Toughness Plot - All Alloys
TYS = 460
UPE = 456.11 - 0.6111(TYS)
Y
Z
New Alloys
Comparison Alloys
2027
2027 + V
2139
Line Z-Z
Average FT-UPE - New Alloy
Line Y-Y
Unit Propagation Energy (KJ/M2)
300.0
250.0
200.0
150.0
100.0
50.0
0.0
375
395
415
435
455
475
495
515
535
Tensile Yield Strength (MPa)

FIG. 2 - Cu Effect
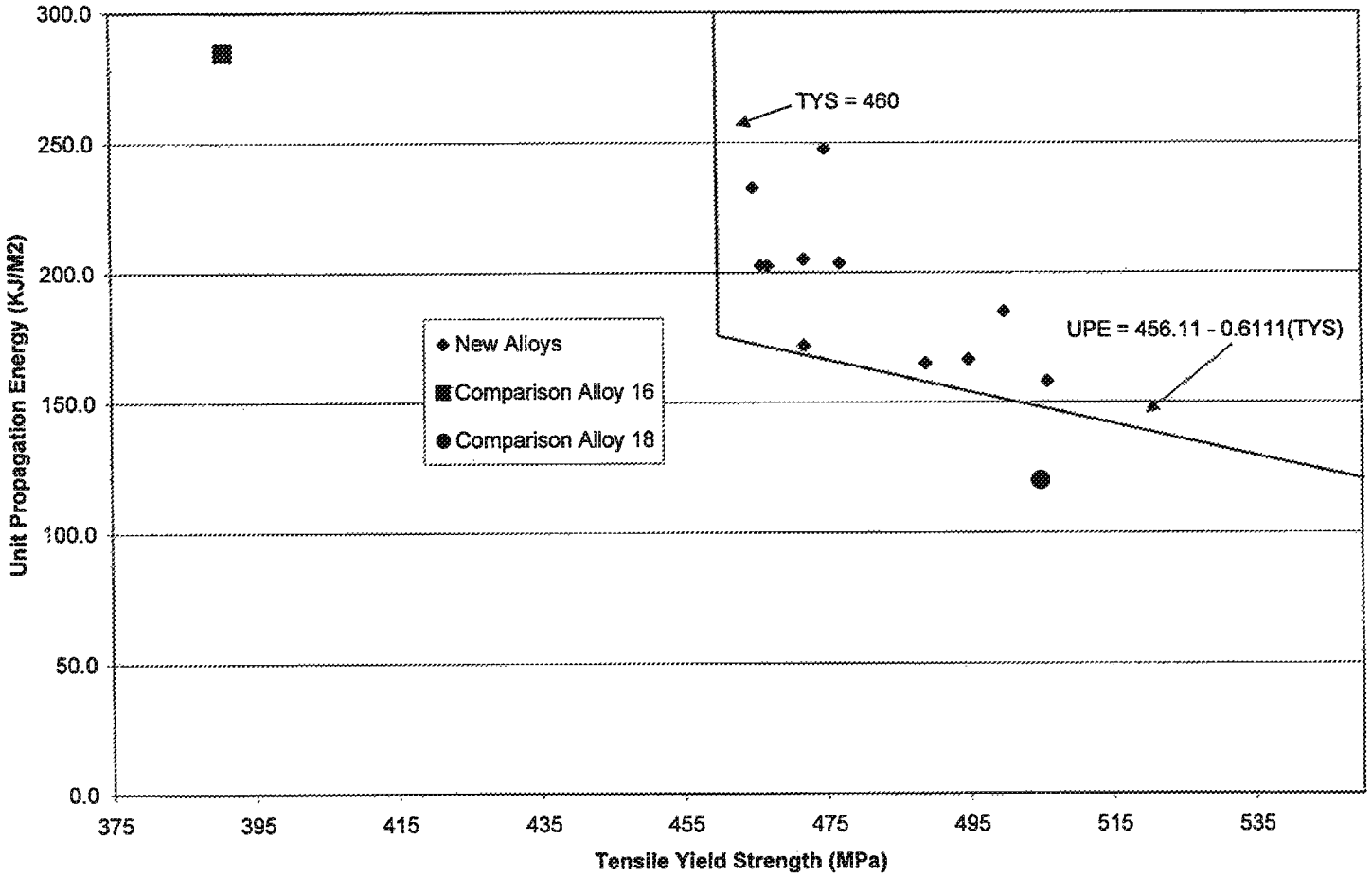

FIG. 3 - Mg Effect
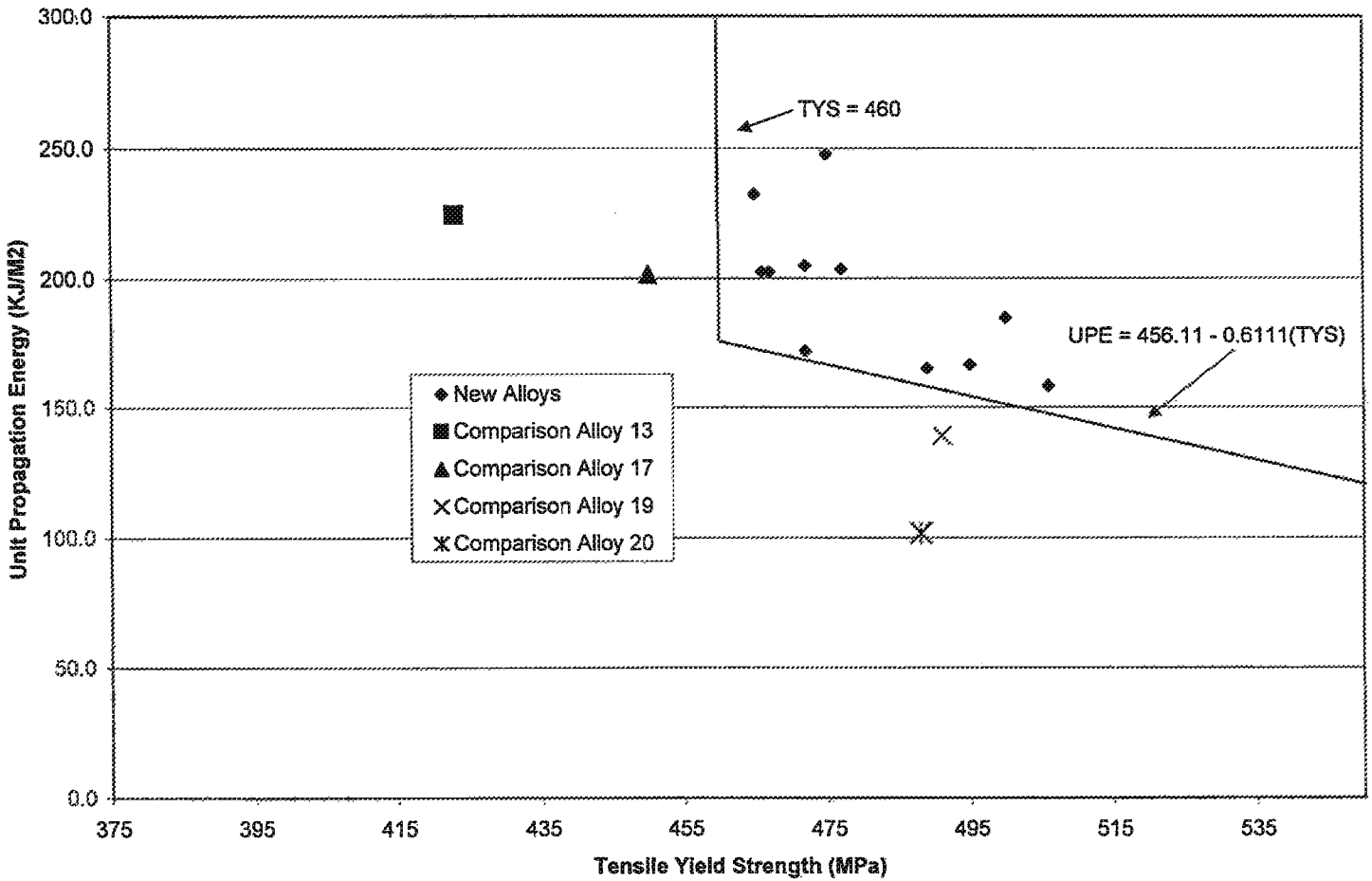

FIG. 4 - Mn Effect
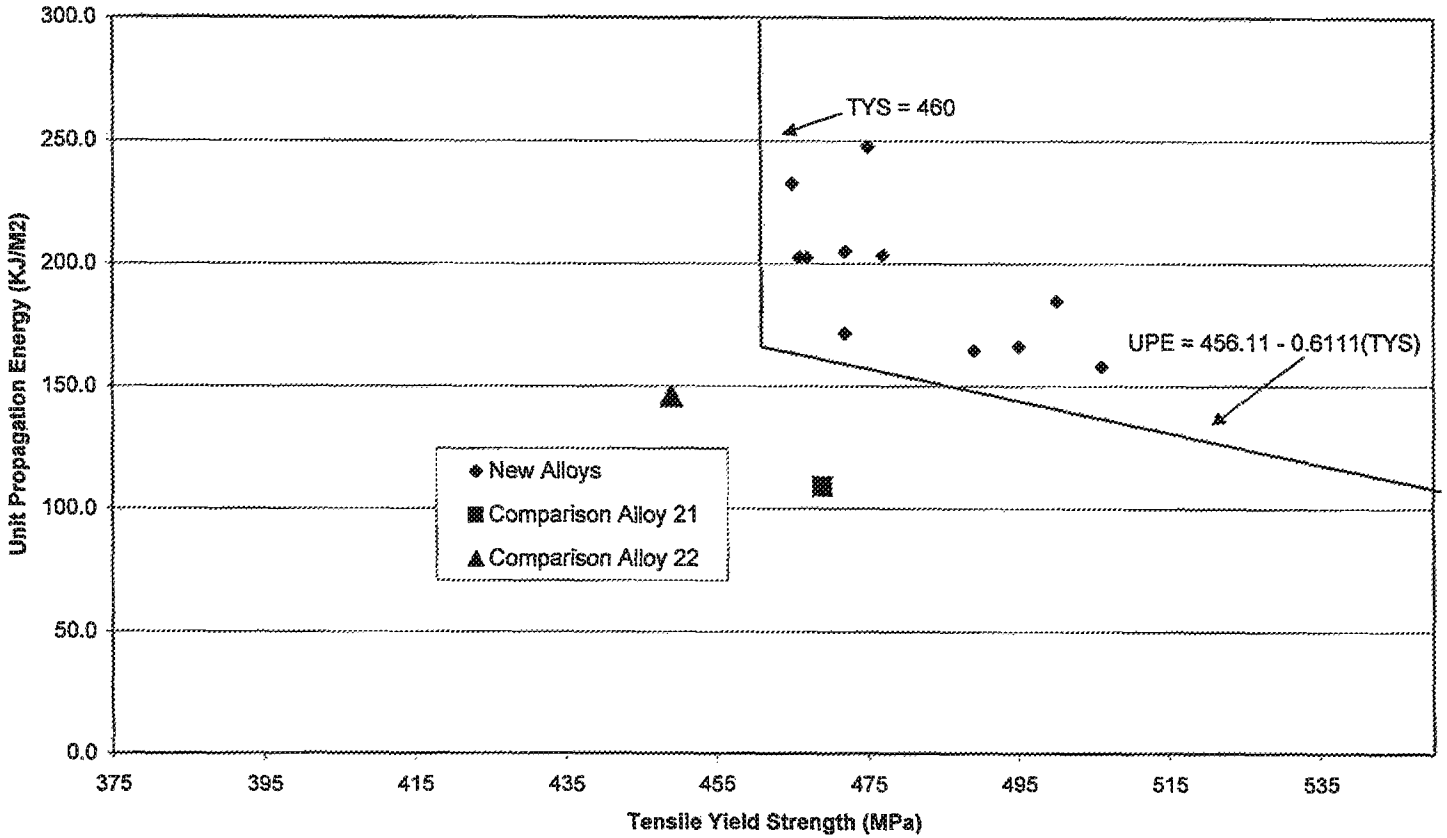

FIG. 5 - V Effect
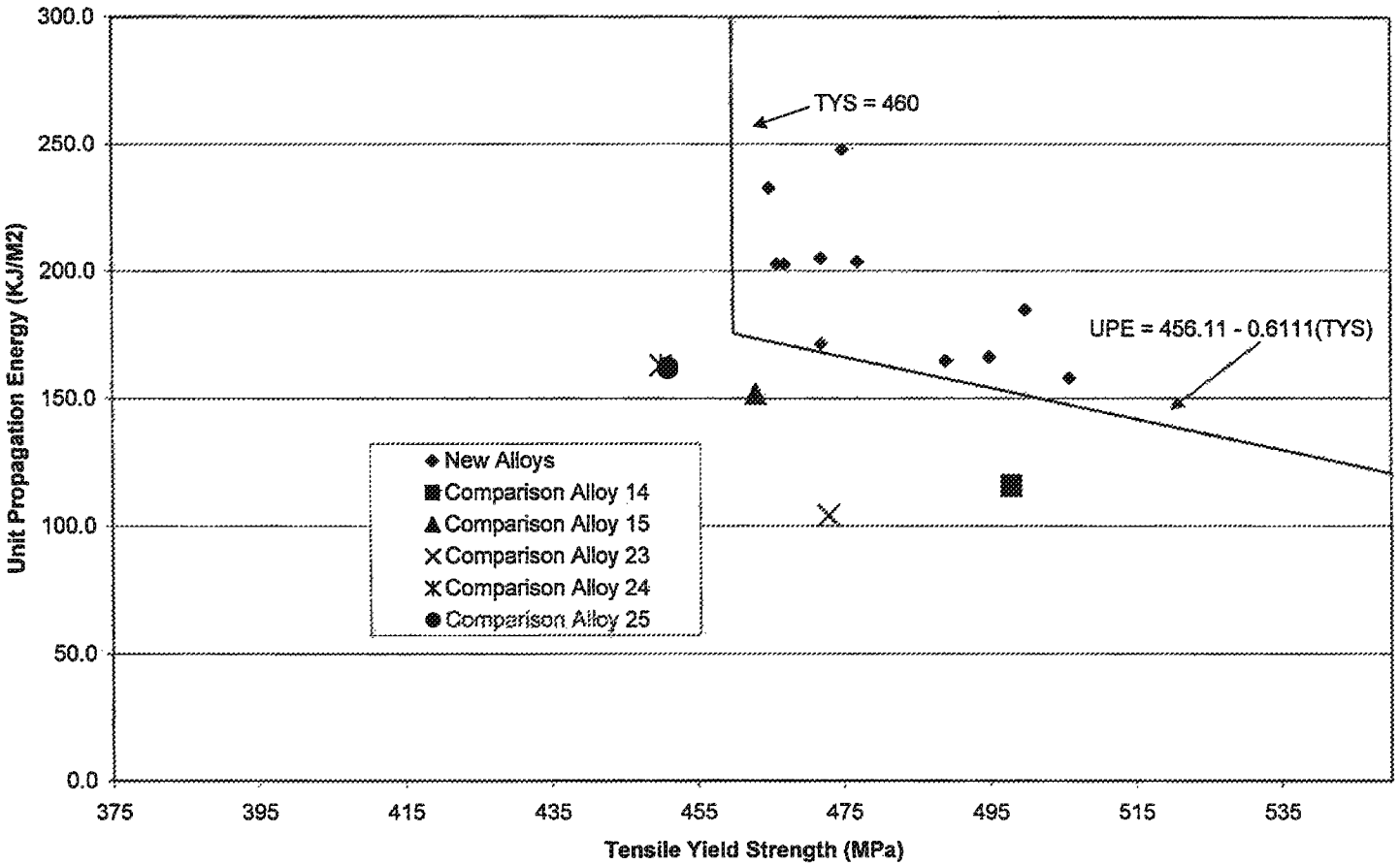

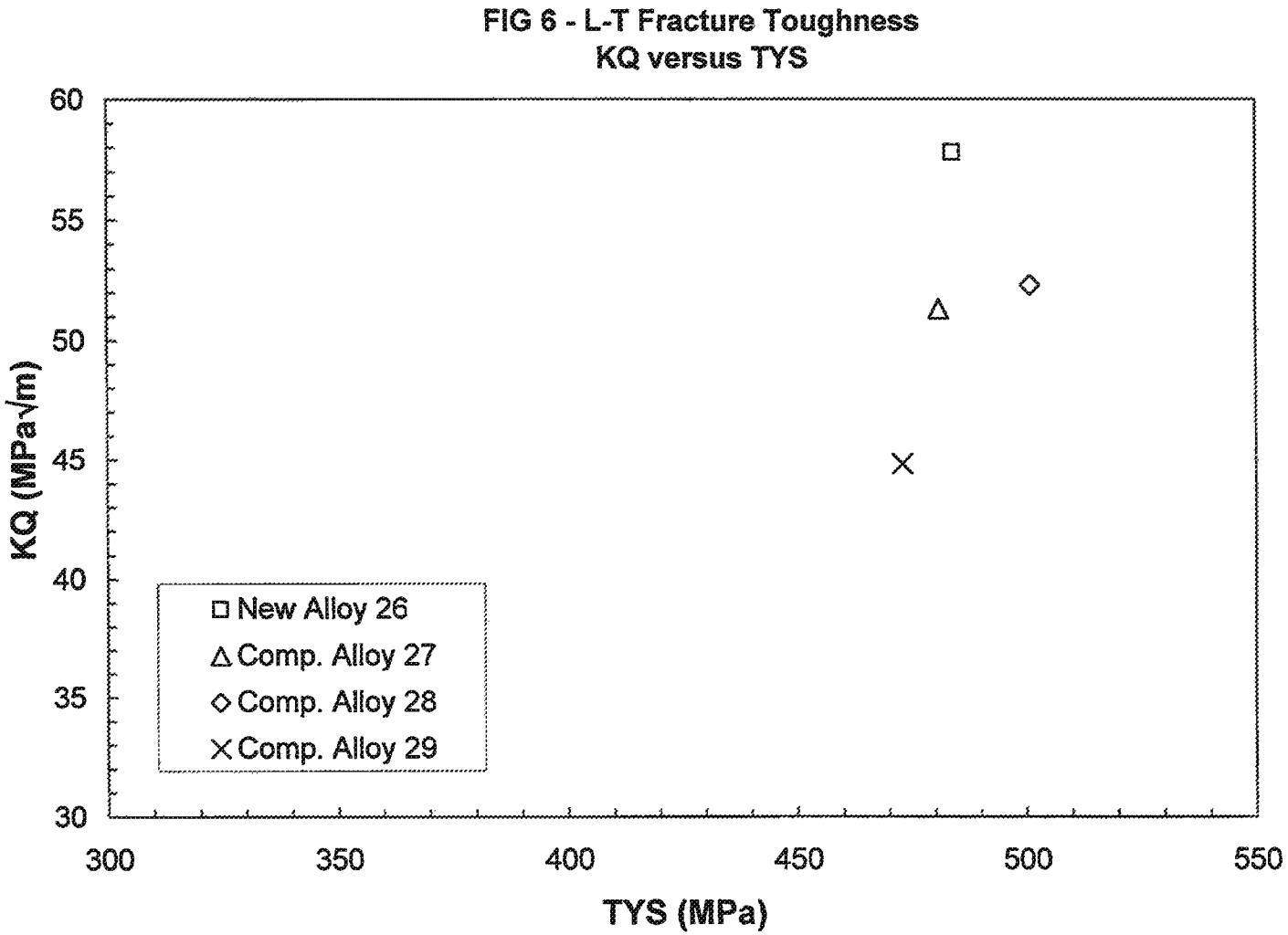
FIG 6 - L-T Fracture Toughness
KQ versus TYS
KQ (MPa√m)
60
55
50
45
40
35
30
300
350
400
450
500
550
TYS (MPa)
New Alloy 26
Comp. Alloy 27
Comp. Alloy 28
Comp. Alloy 29

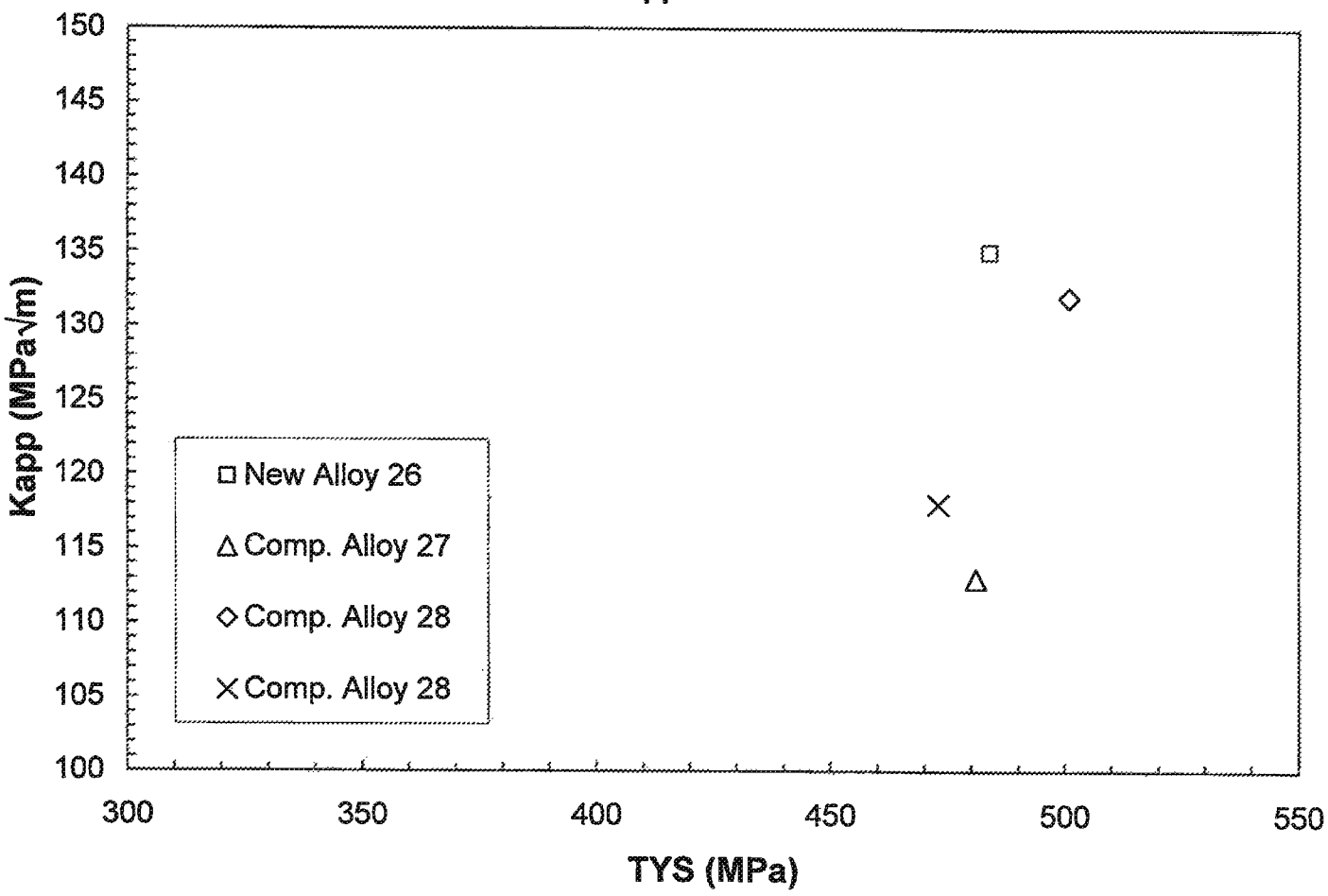
FIG 7 - L-T Plane Stress Fracture Toughness
Kapp versus TYS
Kapp (MPa√m)
150
145
140
135
130
125
120
115
110
105
100
300
350
400
450
500
550
TYS (MPa)
New Alloy 26
Comp. Alloy 27
Comp. Alloy 28
Comp. Alloy 28

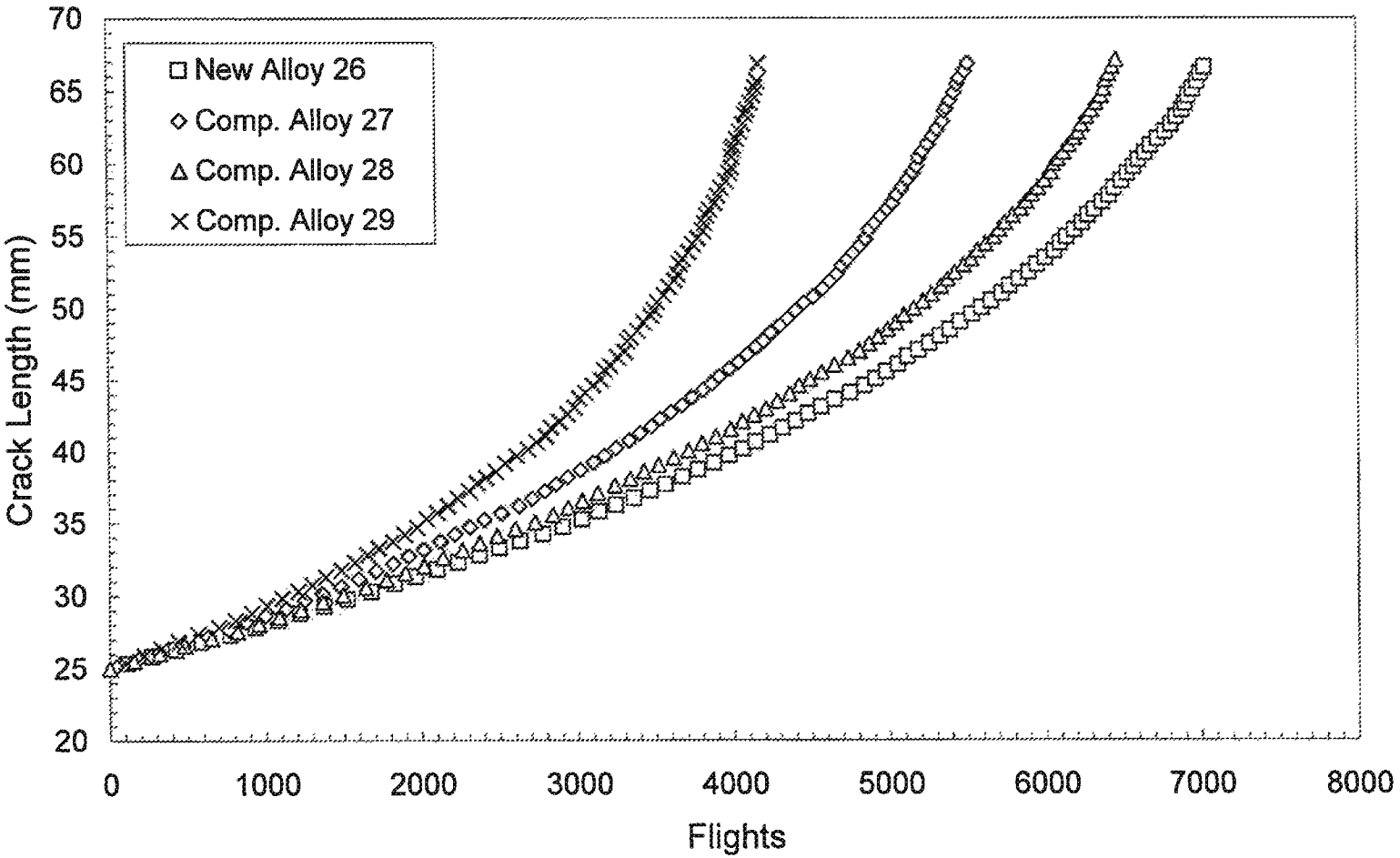
FIG 8 - Spectrum FCG
Crack Length vs Flights Plot
New Alloy 26
Comp. Alloy 27
Comp. Alloy 28
Comp. Alloy 29
Crack Length (mm)
70
65
60
55
50
45
40
35
30
25
20
0
1000
2000
3000
4000
5000
6000
7000
8000
Flights

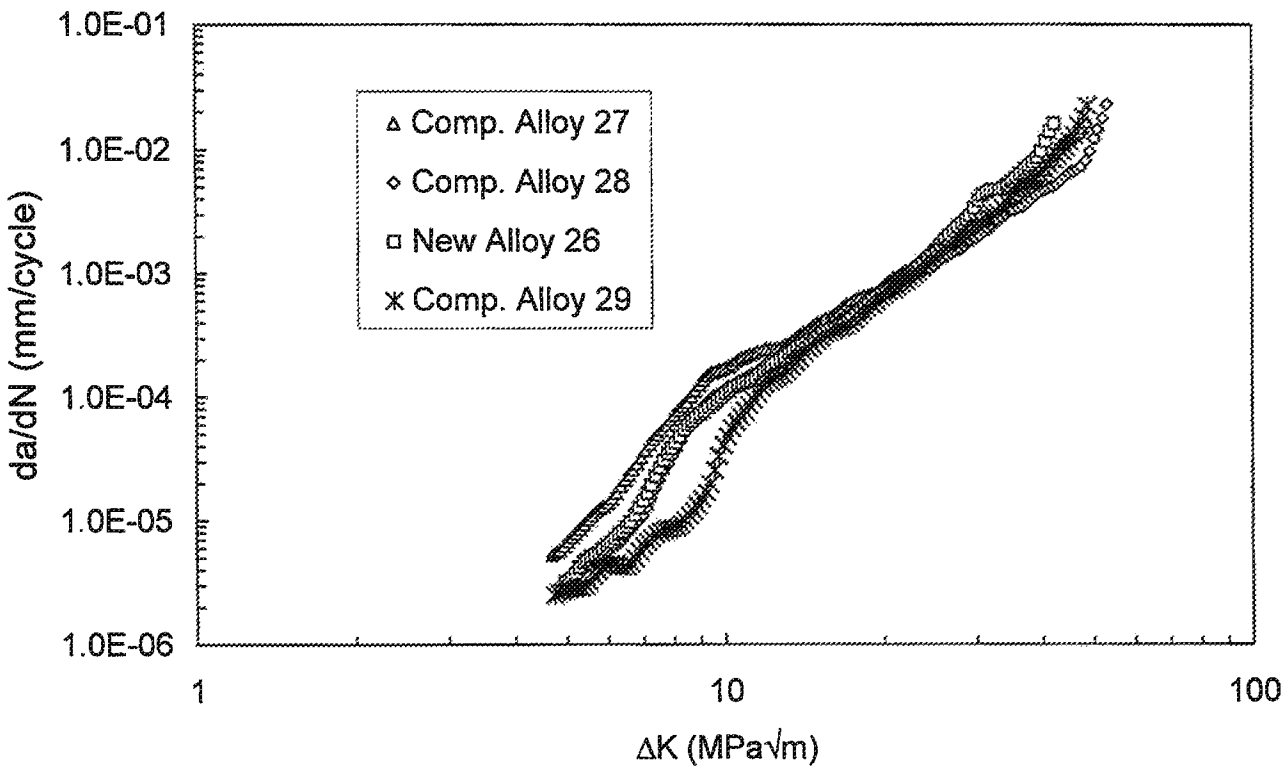
FIG 9 - Constant Amplitude FCG
da/dN versus ΔK

FIG. 10 - Strength v. Toughness for ≈ 1" products
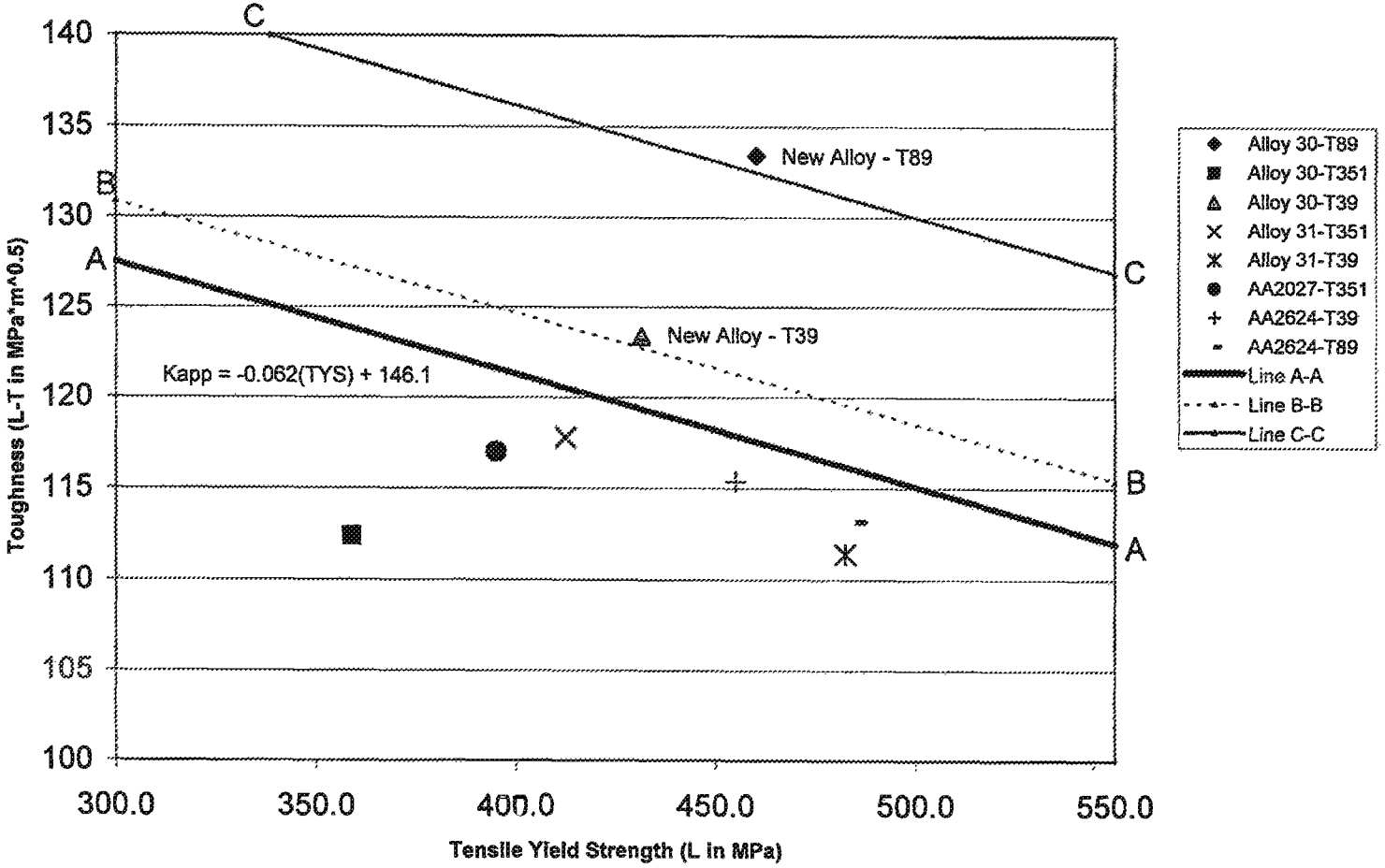

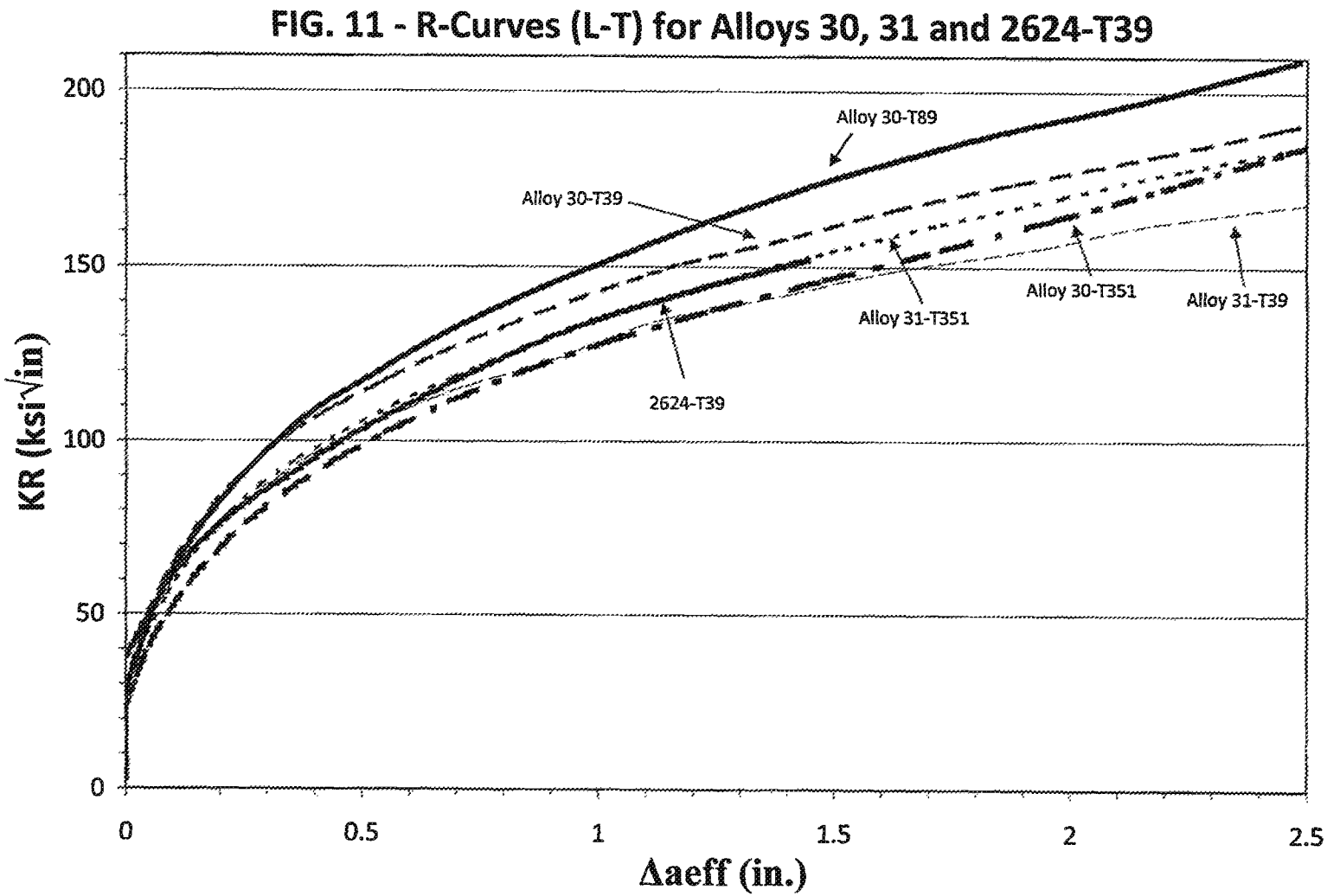
FIG. 11 - R-Curves (L-T) for Alloys 30, 31 and 2624-T39

ALUMINUM-COPPER ALLOYS CONTAINING VANADIUM

CROSS-REFERENCE TO RELATED APPLICATIONS

This application is a continuation of U.S. patent application Ser. No. 12/692,508, entitled "Improved Aluminum-Copper Alloys Containing Vanadiaum", filed Jan. 22, 2010, now U.S. Pat. No. 8,287,668, which claims priority to U.S. Provisional Patent Application No. 61/146,585, entitled "Improved Aluminum-Copper Alloys Containing Vanadium", filed Jan. 22, 2009, and is related to International Patent Application No. PCT/US2010/021849, entitled "Improved Aluminum-Copper Alloys Containing Vanadium", filed Jan. 22, 2010, all of which are incorporated herein by reference in their entireties.

BACKGROUND

Aluminum alloys are useful in a variety of applications. However, improving one property of an aluminum alloy without degrading another property often proves elusive. For example, it is difficult to increase the strength of an alloy without decreasing the toughness of an alloy. Other properties of interest for aluminum alloys include corrosion resistance and fatigue crack growth rate resistance, to name two.

SUMMARY

Broadly, the present disclosure relates to new and improved 2xxx aluminum alloys containing vanadium and having an improved combination of properties. In one embodiment, a new 2xxx alloy consists essentially of from about 3.3 wt. % to about 4.1 wt. % Cu, from about 0.7 wt. % to about 1.3 wt. % Mg, from about 0.01 wt. % to about 0.16 wt. % V, from about 0.05 wt. % to about 0.6 wt. % Mn, from about 0.01 wt. % to about 0.4 wt. % of at least one grain structure control element, the balance being aluminum, incidental elements and impurities. In one embodiment, the combined amount of copper and magnesium does not exceed 5.1 wt. %. In one embodiment, the combined amount of copper and magnesium is at least 4.0 wt. %. In one embodiment, the ratio of copper to magnesium is not greater than 5.0. In one embodiment, the ratio of copper to magnesium is at least 2.75.

Various wrought products, such as rolled products, forgings and extrusions, having an improved combination of properties may be produced from these new alloys. These wrought products may realize improved damage tolerance and/or an improved combination of strength and toughness, as described in further detail below.

These and other aspects, advantages, and novel features of the new alloys described herein are set forth in part in the description that follows, and will become apparent to those skilled in the art upon examination of the following description and figures, or may be learned by practicing the disclosure.

BRIEF DESCRIPTION OF THE DRAWINGS

FIG. 1 is a graph illustrating the tensile yield strength and toughness performance of various alloys.

FIG. 2 is a graph illustrating the effect of Cu additions relative to various alloys.

FIG. 3 is a graph illustrating the effect of Mg additions relative to various alloys.

FIG. 4 is a graph illustrating the effect of Mn additions relative to various alloys.

FIG. 5 is a graph illustrating the effect of V additions relative to various alloys.

FIG. 6 is a graph illustrating the tensile yield strength versus the $K_Q$ fracture toughness for various alloys.

FIG. 7 is a graph illustrating the tensile yield strength versus the $K_{app}$ fracture toughness for various alloys.

FIG. 8 is a graph illustrating spectrum fatigue crack growth resistance of various alloys.

FIG. 9 is a graph illustrating constant amplitude fatigue crack growth resistance of various alloys.

FIG. 10 is a graph illustrating the tensile yield strength and plane stress fracture toughness performance of various alloys.

FIG. 11 is graph containing R-curves in the L-T direction for various alloys.

DETAILED DESCRIPTION

Broadly, the instant disclosure relates to new aluminum-copper alloys having an improved combination of properties. The new aluminum alloys generally comprise (and in some instances consist essentially of) copper, magnesium, manganese, and vanadium, the balance being aluminum, grain structure control elements, optional incidental elements, and impurities. The new alloys may realize an improved combination of strength, toughness, fatigue crack growth resistance, and/or corrosion resistance, to name a few, as described in further detail below. The composition limits of several alloys useful in accordance with the present teachings are disclosed in Table 1, below. All values given are in weight percent.

TABLE 1

Examples of New Alloy Compositions

| Alloy | Cu | Mg | Mn | V |
|---|---|---|---|---|
| A | 3.1-4.1 | 0.7-1.3 | 0.01-0.7 | 0.01-0.16 |
| B | 3.3-3.9 | 0.8-1.2 | 0.1-0.5 | 0.03-0.15 |
| C | 3.4-3.7 | 0.9-1.1 | 0.2-0.4 | 0.05-0.14 |

Copper (Cu) is included in the new alloy, and generally in the range of from about 3.1 wt. % to about 4.1 wt. % Cu. As illustrated in the below examples, when copper goes below about 3.1 wt. % or exceeds about 4.1 wt. %, the alloy may not realize an improved combination of properties. For example, when copper exceeds about 4.1 wt. %, the fracture toughness of the alloy may decrease. When copper is less than about 3.1 wt. %, the strength of the alloy may decrease. In one embodiment, the new alloy includes at least about 3.1 wt. % Cu. In other embodiments, the new alloy may include at least about 3.2 wt. % Cu, or at least about 3.3 wt. % Cu, or at least about 3.4 wt. % Cu. In one embodiment, the new alloy includes not greater than about 4.1 wt. % Cu. In other embodiments, the new alloy may include not greater than about 4.0 wt. % Cu, or not greater than about 3.9 wt. % Cu, or not greater than about 3.8 wt. % Cu, or not greater than about 3.7 wt. % Cu.

Magnesium (Mg) is included in the new alloy, and generally in the range of from about 0.7 wt. % to about 1.3 wt. % Mg. As illustrated in the below examples, when magnesium goes below about 0.7 wt. % or exceeds about 1.3 wt. %, the alloy may not realize an improved combination of properties. For example, when magnesium exceeds about 1.3 wt. %, the fracture toughness of the alloy may decrease. When magnesium is less than about 0.7 wt. %, the strength of the alloy may decrease. In one embodiment, the new alloy includes at least about 0.7 wt. % Mg. In other embodiments, the new alloy may include at least about 0.8 wt. % Mg, or at least about 0.9 wt. % Mg. In one embodiment, the new alloy includes not greater than about 1.3 wt. % Mg. In other embodiments, the new alloy may include not greater than about 1.2 wt. % Mg, or not greater than about 1.1 wt. % Mg.

Manganese (Mn) is included in the new alloy and generally in the range of from about 0.01 wt. % to about 0.7 wt. % Mn. As illustrated in the below examples, when manganese goes below about 0.01 wt. % or exceeds about 0.7 wt. %, the alloy may not realize an improved combination of properties. For example, when manganese exceeds about 0.7 wt. %, the fracture toughness of the alloy may decrease. When manganese is less than about 0.01 wt. %, the fracture toughness of the alloy may decrease. In one embodiment, the new alloy includes at least about 0.05 wt. % Mn. In other embodiments, the new alloy may include at least about 0.1 wt. % Mn, or at least about 0.2 wt. % Mn, or at least about 0.25 wt. % Mn. In one embodiment, the new alloy includes not greater than about 0.7 wt. % Mn. In other embodiments, the new alloy may include not greater than about 0.6 wt. % Mn, or not greater than about 0.5 wt. % Mn, or not greater than about 0.4 wt. % Mn.

Vanadium (V) is included in the new alloy and generally in the range of from about 0.01 wt. % to about 0.16 wt. % V. As illustrated in the below examples, when vanadium goes below about 0.01 wt. % or exceeds about 0.16 wt. %, the alloy may not realize an improved combination of properties. For example, when vanadium exceeds about 0.16 wt. %, the strength and/or fracture toughness of the alloy may decrease. When vanadium is less than about 0.01 wt. %, the fracture toughness of the alloy may decrease. In one embodiment, the new alloy includes at least about 0.01 wt. % V. In other embodiments, the new alloy may include at least about 0.03 wt. % V, or at least about 0.07 wt. % V, or at least about 0.09 wt. % V. In one embodiment, the new alloy includes not greater than about 0.16 wt. % V. In other embodiments, the new alloy may include not greater than about 0.15 wt. % V, or not greater than about 0.14 wt. % V, or not greater than about 0.13 wt. % V, or not greater than about 0.12 wt. % V. In one embodiment, the alloy includes V in the range of from about 0.05 wt. % to about 0.15 wt. %.

Zinc (Zn) may optionally be included in the new alloy as an alloying ingredient, and generally in the range of from about 0.3 wt. % to about 1.0 wt. % Zn. When Zn is not included in the alloy as an alloying ingredient, it may be present in the new alloy as an impurity, and in an amount of up to about 0.25 wt. %.

Silver (Ag) may optionally be included in the new alloy as an alloying ingredient, and generally in the range of from about 0.01 wt. %, or from about 0.05 wt. %, or about 0.1 wt. %, to about 0.4 wt. %, or to about 0.5 wt. % or to about 0.6 wt. % Ag. For example, silver could be added to the alloy to improve corrosion resistance. In other embodiments, the new alloy is substantially free of silver (e.g., silver is present in the alloy only as an impurity (if at all), generally at less than about 0.01 wt. % Ag, and does not materially affect the properties of the new alloy).

As noted above, the new alloy includes copper and magnesium. The total amount of copper and magnesium (Cu+Mg) may be related to alloy properties. For example, when an alloy contains less than about 4.1 wt. %, or contains more than about 5.1 wt. %, the alloy may not realize an improved combination of properties. For example, when Cu+Mg exceeds about 5.1 wt. %, the fracture toughness of the alloy may decrease. When Cu+Mg is less than about 4.1 wt. %, the strength of the alloy may decrease. In one embodiment, the new alloy includes at least about 4.1 wt. % Cu+Mg. In other embodiments, the new alloy may include at least about 4.2 wt. % Cu+Mg, or at least about 4.3 wt. % Cu+Mg, or at least about 4.4 wt. % Cu+Mg. In one embodiment, the new alloy includes not greater than about 5.1 wt. % Cu+Mg. In other embodiments, the new alloy may include not greater than about 5.0 wt. % Cu+Mg, or not greater than about 4.9 wt. % Cu+Mg, or not greater than about 4.8 wt. % Cu+Mg.

Similarly, the ratio of copper-to-magnesium (Cu/Mg ratio) may be related to alloy properties. For example, when the Cu/Mg ratio is less than about 2.6 or is more than about 5.5, the alloy may not realize an improved combination of properties. For example, when the Cu/Mg ratio exceeds about 5.5 or is less than about 2.6, the strength-to-toughness relationship of the alloy may be low. In one embodiment, the Cu/Mg ratio of the new alloy is at least about 2.6. In other embodiments, the Cu/Mg ratio of the new alloy is at least about 2.75, or at least about 3.0, or at least about 3.25, or at least about 3.5. In one embodiment, the Cu/Mg ratio of the new alloy is not greater than about 5.5. In other embodiments, the Cu/Mg ratio of the new alloy is not greater than about 5.0, or is not greater than about 4.75, or is not greater than about 4.5, or is not greater than about 4.25, or is not greater than about 4.0.

As noted above, the new alloys generally include the stated alloying ingredients, the balance being aluminum, grain structure control elements, optional incidental elements, and impurities. As used herein, "grain structure control element" means elements or compounds that are deliberate alloying additions with the goal of forming second phase particles, usually in the solid state, to control solid state grain structure changes during thermal processes, such as recovery and recrystallization. For purposes of the present patent application, grain structure control elements includes Zr, Sc, Cr, and Hf, to name a few, but excludes Mn and V.

In the alloying industry, manganese may be considered to be both an alloying ingredient and a grain structure control element—the manganese retained in solid solution may enhance a mechanical property of the alloy (e.g., strength), while the manganese in particulate form (e.g., as $Al_6Mn$, $Al_{12}Mn_3Si_2$—sometimes referred to as dispersoids) may assist with grain structure control. Similar results may be witnessed with vanadium. However, since both Mn and V are separately defined with their own composition limits in the present patent application, they are not within the definition of "grain structure control elements" for the purposes of the present patent application.

The amount of grain structure control material utilized in an alloy is generally dependent on the type of material utilized for grain structure control and/or the alloy production process. In one embodiment, the grain structure control element is Zr, and the alloy includes from about 0.01 wt. % to about 0.25 wt. % Zr. In some embodiments, Zr is included in the alloy in the range of from about 0.05 wt. %, or from about 0.08 wt. %, to about 0.12 wt. %, or to about 0.15 wt. %, or to about 0.18 wt. %, or to about 0.20 wt. % Zr. In one embodiment, Zr is included in the alloy and in the range of from about 0.01 wt. % to about 0.20 wt. % Zr.

Scandium (Sc), chromium (Cr), and/or hafnium (Hf) may be included in the alloy as a substitute (in whole or in part) for Zr, and thus may be included in the alloy in the same or similar amounts as Zr. In one embodiment, the grain structure control element is at least one of Sc and Hf.

As used herein, "incidental elements" means those elements or materials, other than the above alloying elements and grain structure control elements, that may optionally be added to the alloy to assist in the production of the alloy.

Examples of incidental elements include casting aids, such as grain refiners and deoxidizers.

Grain refiners are inoculants or nuclei to seed new grains during solidification of the alloy. An example of a grain refiner is a ⅜ inch rod comprising 96% aluminum, 3% titanium (Ti) and 1% boron (B), where virtually all boron is present as finely dispersed $TiB_2$ particles. During casting, the grain refining rod is fed in-line into the molten alloy flowing into the casting pit at a controlled rate. The amount of grain refiner included in the alloy is generally dependent on the type of material utilized for grain refining and the alloy production process. Examples of grain refiners include Ti combined with B (e.g., $TiB_2$) or carbon (TiC), although other grain refiners, such as Al—Ti master alloys may be utilized. Generally, grain refiners are added in an amount of ranging from about 0.0003 wt. % to about 0.005 wt. % to the alloy, depending on the desired as-cast grain size. In addition, Ti may be separately added to the alloy in an amount up to 0.03 wt. % to increase the effectiveness of grain refiner. When Ti is included in the alloy, it is generally present in an amount of from about 0.01 wt. %, or from about 0.03 wt. %, to about 0.10 wt. %, or to about 0.15 wt. %. In one embodiment, the aluminum alloy includes a grain refiner, and the grain refiner is at least one of $TiB_2$ and TiC, where the wt. % of Ti in the alloy is from about 0.01 wt. % to about 0.1 wt. %.

Some incidental elements may be added to the alloy during casting to reduce or restrict (and is some instances eliminate) ingot cracking due to, for example, oxide fold, pit and oxide patches. These types of incidental elements are generally referred to herein as deoxidizers. Examples of some deoxidizers include Ca, Sr, and Be. When calcium (Ca) is included in the alloy, it is generally present in an amount of up to about 0.05 wt. %, or up to about 0.03 wt. %. In some embodiments, Ca is included in the alloy in an amount of about 0.001-0.03 wt % or about 0.05 wt. %, such as 0.001-0.008 wt. % (or 10 to 80 ppm). Strontium (Sr) may be included in the alloy as a substitute for Ca (in whole or in part), and thus may be included in the alloy in the same or similar amounts as Ca. Traditionally, beryllium (Be) additions have helped to reduce the tendency of ingot cracking, though for environmental, health and safety reasons, some embodiments of the alloy are substantially Be-free. When Be is included in the alloy, it is generally present in an amount of up to about 20 ppm.

Incidental elements may be present in minor amounts, or may be present in significant amounts, and may add desirable or other characteristics on their own without departing from the alloy described herein, so long as the alloy retains the desirable characteristics described herein. It is to be understood, however, that the scope of this disclosure should not/cannot be avoided through the mere addition of an element or elements in quantities that would not otherwise impact on the combinations of properties desired and attained herein.

As used herein, impurities are those materials that may be present in the new alloy in minor amounts due to, for example, the inherent properties of aluminum or and/or leaching from contact with manufacturing equipment. Iron (Fe) and silicon (Si) are examples of impurities generally present in aluminum alloys. The Fe content of the new alloy should generally not exceed about 0.25 wt. %. In some embodiments, the Fe content of the alloy is not greater than about 0.15 wt. %, or not greater than about 0.10 wt. %, or not greater than about 0.08 wt. %, or not greater than about 0.05 or 0.04 wt. %. Likewise, the Si content of the new alloy should generally not exceed about 0.25 wt. %, and is generally less than the Fe content. In some embodiments, the Si content of the alloy is not greater than about 0.12 wt. %, or not greater than about 0.10 wt. %, or not greater than about 0.06 wt. %, or not greater than about 0.03 or 0.02 wt. %. When Zn is not included in the new alloy as an alloying ingredient, it may be present in the new alloy as an impurity, and in an amount of up to about 0.25 wt. %. When Ag is not included in the new alloy as an alloying ingredient, it may be present in the new alloy as an impurity, and in an amount of up to about 0.01 wt. %.

In some embodiments, the alloy is substantially free of other elements, meaning that the alloy contains no more than about 0.25 wt. % of any other elements, except the alloying elements, grain structure control elements, optional incidental elements, and impurities, described above. Further, the total combined amount of these other elements in the alloy does not exceed about 0.5 wt. %. The presence of other elements beyond these amounts may affect the basic and novel properties of the alloy, such as its strength, toughness, and/or fatigue resistance, to name a few. In one embodiment, each one of these other elements does not exceed about 0.10 wt. % in the alloy, and the total of these other elements does not exceed about 0.35 wt. %, or about 0.25 wt. % in the alloy. In another embodiment, each one of these other elements does not exceed about 0.05 wt. % in the alloy, and the total of these other elements does not exceed about 0.15 wt. % in the alloy. In another embodiment, each one of these other elements does not exceed about 0.03 wt. % in the alloy, and the total of these other elements does not exceed about 0.1 wt. % in the alloy.

Except where stated otherwise, the expression "up to" when referring to the amount of an element means that that elemental composition is optional and includes a zero amount of that particular compositional component. Unless stated otherwise, all compositional percentages are in weight percent (wt. %).

The new alloy may be utilized in wrought products. A wrought product is a product that has been worked to form one of a rolled product (e.g., sheet, plate), extrusion, or forging. The new alloy can be prepared into wrought form, and in the appropriate temper, by more or less conventional practices, including melting and direct chill (DC) casting into ingot form. After conventional scalping, lathing or peeling (if needed) and homogenization, these ingots may be further processed into the wrought product by, for example, rolling into sheet or plate, or extruding or forging into special shaped sections. After solution heat treatment (SHT) and quenching, the product may be optionally mechanically stress relieved, such as by stretching and/or compression. In some embodiments, the alloy may be artificially aged, such as when producing wrought products in a T8 temper.

The new alloy is generally cold worked and naturally aged (a T3 temper), or cold worked and artificially aged (a T8 temper). In one embodiment, the new alloy is cold worked and naturally aged to a T39 temper. In another embodiment, the new alloy is cold worked and artificially aged to peak strength in a T89 temper (e.g., by aging at about 310° F. for about 48 hours). In other embodiments, the new alloy is processed to one of a T851, T86, T351, or T36 temper. Other tempers may be useful.

As used herein, "sheet" means a rolled product where (i) the sheet has a final thickness of not greater than 0.249 inch (about 6.325 mm), or (ii) as rolled stock in thicknesses less than or equal to 0.512 inch (about 13 mm) thick when cold rolled after the final hot working and prior to solution heat treatment. In one embodiment, the new alloy is incorporated into a sheet product having a minimum final thickness of at least about 0.05 inch (about 1.27 mm). The maximum thickness of these sheet products may be as provided in either (i) or (ii), above.

As used herein, "plate" means a hot rolled product or a hot rolled product that is cold rolled after solution heat treatment and that has a final thickness of at least 0.250 inch. In one embodiment, the new alloy is incorporated into a plate product having a final thickness of at least about 0.5 inch. It is anticipated that the improved properties realized by the new alloy may be realized in plate products having a thickness of up to about 2 inches. In one embodiment, the plate products are utilized as an aerospace structural member, such as aircraft fuselage skins or panels, which may be clad with a corrosion protecting outer layer, lower wing skins, horizontal stabilizers, pressure bulkheads and fuselage reinforcements, to name a few. In other embodiments, the alloys are used in the oil and gas industry (e.g., for drill piped and/or drill risers)

As illustrated in the below examples, the new alloys disclosed herein achieve an improved combination of properties relative to other 2xxx series alloys. For example, the new alloys may achieve an improved combination of two or more of the following properties: ultimate tensile strength (UTS), tensile yield strength (TYS), fracture toughness (FT), spectrum fatigue crack growth resistance (SFCGR), constant amplitude fatigue crack growth resistance (CAFCGR), and/or corrosion resistance, to name a few. In one embodiment, the new alloy achieves at least about a 5% improvement in one or more of these properties, as measured relative to a similarly prepared conventional 2624 alloy in the same temper, and with at least equivalent performance of at least one other property. In other embodiments, the new alloy achieves at least about a 6% improvement, or at least about a 7% improvement, or at least about an 8% improvement, or at least about a 9% improvement, or at least about a 10% improvement, or at least about an 11% improvement, or at least about a 12% improvement, or at least about a 13% improvement, or at least about a 14% improvement, or at least about a 15% improvement, or more, in one or more of these properties, as measured relative to a similarly prepared conventional 2624 alloy in the same temper, and with at least equivalent performance of at least one other property. This is especially true for the new alloys when produced in a T89 temper.

Rolled products produced from the new alloy may realize improved strength. Rolled products produced from the new alloy may realize a longitudinal tensile yield strength (TYS-L −0.2% offset) of at least about 460 MPa in the T89 temper, and at least about 430 in the T39 temper MPa. In one embodiment, a rolled product realizes a TYS-L of at least about 5 MPa more than the above minimum T89 or T39 TYS-L value, as appropriate (e.g., at least about 465 MPa in the T89 temper and at least about 435 MPa in the T39 temper). In other embodiments, a rolled product realizes a TYS-L of at least about 10 MPa more, or at least about 15 MPa more, or at least about 20 MPa more, or at least about 25 MPa more, or at least about 30 MPa more, or at least about 35 MPa more, or at least about 40 MPa more, or at least about 45 MPa more, and possibly more, than the above minimum T89 or T39 TYS-L value, as appropriate. Similar longitudinal strengths may be achieved by forgings, and higher strengths may be achieved for extrusions.

Rolled products produced from the new alloy may realize a longitudinal ultimate tensile strength (UTS-L) of at least about 480 MPa in the T89 temper, and at least about 450 MPa in the T39 temper MPa. In one embodiment, a rolled product realizes a UTS-L of at least about 5 MPa more than the above minimum T89 or T39 UTS-L value, as appropriate (e.g., at least about 485 MPa in the T89 temper and at least about 450 MPa in the T39 temper). In other embodiments, a rolled product realizes a UTS-L of at least about 10 MPa more, or at least about 15 MPa more, or at least about 20 MPa more, or at least about 25 MPa more, or at least about 30 MPa more, or at least about 35 MPa more, and possibly more, than the above minimum T89 or T39 TYS-L value, as appropriate.

Rolled products produced from the new alloy may realize improved toughness. At the above longitudinal tensile yield strengths, the rolled products may realize a strength-to-toughness combination that matches or is above performance line Z-Z of FIG. 1 relative to toughness measured by unit propagation energy (UPE) testing. In one embodiment, the rolled products realizes a strength-to-toughness combination that matches or is above performance line Y-Y of FIG. 1 relative to toughness measured by UPE. In one embodiment, the rolled products realizes a strength-to-toughness combination that matches or is above performance line A-A of FIG. 10 relative to toughness measured by plane stress testing ($K_{app}$). In one embodiment, the rolled products realizes a strength-to-toughness combination that matches or is above performance line B-B of FIG. 10 measured by plane stress testing. In one embodiment, the rolled products realizes a strength-to-toughness combination that matches or is above performance line C-C of FIG. 10 measured by plane stress testing. For plain strain toughness, the rolled products may realize an L-T toughness ($K_{Ic}$) of at least about 53 MPa√m, or at least about 54 MPa√m, or at least about 55 MPa√m, or at least about 56 MPa√m, or at least about 57 MPa√m, or at least about 58 MPa√m, or at least about 59 MPa√m, or at least about 60 MPa√m, or more, in combination with good longitudinal strength (UTS and/or TYS), depending on temper, as described above. Similar L-T toughness may be achieved by forgings, and higher toughness may be achieved for extrusions.

With respect to corrosion resistance, wrought products produced from the new alloy may be corrosion resistant, and at the tempers provided for above. In one embodiment, a new alloy products achieves an EXCO rating of ED or better (e.g., EC, EB, EA or P), at the T/10 plane when tested in accordance with ASTM G34, and after 96 hours of exposure. In one embodiment, a new alloy product has a pitting depth of less than about 150 microns at the T/10 plane after 6 hours of exposure when tested in accordance ASTM G110. In one embodiment, a new alloy product passes stress corrosion cracking resistance (SCC) tests in the long transverse (LT) direction in accordance with ASTM G44 and G47, using a ⅛" diameter, 2" long tensile bar with a double shoulder, at a stress level of the about 250 MPa. For these SCC tests, the alloy products generally do not break after 30 days of exposure.

EXAMPLES

Example 1

Performance of New Alloy in T89 Temper

Alloy Preparation

Rectangular ingots of the size 2.25"×3.75" are cast for the various compositions of the new alloy, as provided in Table 2, below (all values in wt. %).

TABLE 2

Composition of various new alloys

| Alloy | Cu | Mg | V | Mn | Balance |
|---|---|---|---|---|---|
| 1 | 3.52 | 0.98 | 0.14 | 0.28 | Aluminum, grain |
| 2 | 3.42 | 0.99 | 0.11 | 0.29 | structure control |
| 3 | 3.38 | 1.22 | 0.11 | 0.28 | elements, optional |

TABLE 2-continued

| Composition of various new alloys | | | | | |
|---|---|---|---|---|---|
| Alloy | Cu | Mg | V | Mn | Balance |
| 4 | 3.5 | 0.98 | 0.11 | 0.29 | incidental elements and impurities |
| 5 | 3.46 | 0.97 | 0.068 | 0.29 | |
| 6 | 3.41 | 0.96 | 0.03 | 0.29 | |
| 7 | 4.04 | 0.82 | 0.11 | 0.28 | |
| 8 | 3.84 | 0.99 | 0.11 | 0.29 | |
| 9 | 3.47 | 0.97 | 0.11 | 0.051 | |
| 10 | 3.53 | 0.98 | 0.11 | 0.6 | |
| 11 | 4.06 | 0.95 | 0.11 | 0.3 | |

All Table 2 alloys contain zirconium and in the range of from about 0.10 to about 0.18 wt. % Zr. All Table 2 alloys contain not greater than about 0.15 wt. % Fe and not greater than about 0.10 wt. % Si.

Alloys having compositions outside of the new alloy composition range are also cast for comparison purposes, including three prior art Aluminum Association alloys, the compositions of which are provided in Table 3, below.

TABLE 3

| Composition of comparison alloys | | | | | |
|---|---|---|---|---|---|
| Alloy | Cu | Mg | V | Mn | Balance |
| 12 | 3.41 | 0.95 | 0.11 | 0.29 | Aluminum, grain structure control elements, optional incidental elements and impurities |
| 13 | 3.54 | 0.5 | 0.11 | 0.28 | |
| 14 | 3.83 | 1.07 | 0 | 0.33 | |
| 15 | 3.48 | 0.98 | 0.18 | 0.3 | |
| 16 | 2.92 | 0.82 | 0.11 | 0.28 | |
| 17 | 3.86 | 0.6 | 0.11 | 0.28 | |
| 18 | 4.24 | 0.96 | 0.11 | 0.3 | |
| 19 | 3.48 | 1.4 | 0.1 | 0.3 | |
| 20 | 3.55 | 1.62 | 0.1 | 0.3 | |
| 21 | 3.5 | 0.95 | 0.12 | 0.82 | |
| 22 | 3.57 | 0.96 | 0.1 | 1.02 | |
| 23 | 3.49 | 0.96 | 0.18 | 0.3 | |
| 24 | 3.58 | 0.98 | 0.22 | 0.31 | |
| 25 | 3.43 | 0.93 | 0.001 | 0.3 | |
| AA2027 | 4.43 | 1.26 | 0 | 0.87 | |
| AA2027 + V | 4.24 | 1.23 | 0.11 | 0.84 | |
| AA2139 | 4.74 | 0.44 | 0.002 | 0.26 | |

All Table 3 alloys, except alloys 12, 15 and AA2139, contain zirconium and in the range of from about 0.10 to about 0.13 wt. % Zr. Alloys 12, 15 and AA2139 contain not greater than 0.001 wt. % Zr. AA2139 contains about 0.34 wt. % Ag. All Table 3 alloys contain not greater than about 0.15 wt. % Fe and not greater than about 0.10 wt. % Si.

All ingots are then homogenized using the following practice:

Heat up in 4 hours to 910° F.
Soak at 910° F. for 4 hours,
Ramp in 1 hr to 940° F.,
Soak at 940° F. for 4 hours
Ramp in 2 hours to 970° F.,
Soak at 970° F. for 24 hours
Air cooling The surfaces of the homogenized ingots are then scalped (~0.1" thick), after which the ingots are heated to 940° F. and then hot rolled at ~900° F. During rolling, the slab is reheated to 940° F. if the temperature drops below 750° F. The ingot is straight rolled to 0.2" gauge with about 0.3" reduction per pass. The hot rolled product is then solution heat treated at 970° F. for 1 hr and cold water quenched. The product is then cold rolled to 0.18 inch (about a 10% reduction) within 2 hours after quenching. The cold rolled product is then stretched about 2% for stress relief.

The new alloys (1-11)) and comparison alloys (12-25) are naturally aged for at least 96 hours at room temperature, and are then artificially aged at about 310° F. for about 48 hours to achieve peak strength and a T89 temper (i.e., solution heat treated, cold worked, and then artificially aged). AA2027, AA2027+V and AA2139 are similarly produced to achieve peak strength at a T89 temper.

Strength and Toughness Testing

After aging, all alloys are subjected to tensile tests, including tensile yield strength (TYS) tests, in accordance with ASTM E8 and B557. The measured TYS values in the longitudinal (L) direction are provided in Tables 4 and 5, below. All alloys are also subjected to tear tests in accordance with ASTM B871 in the L-T orientation. The tear test provides a measure of fracture toughness. The specimen size is 0.25" (thickness)×1.438" (width)×2.25" (length)—per FIG. 2 of ASTM B871, specimen type 5. The unit propagation energy (UPE) results from these tests are provided in Tables 4 and 5, below. All reported TYS and UPE values are an average of the measurement of three specimens.

TABLE 4

| Composition and properties of new alloys | | | | | | |
|---|---|---|---|---|---|---|
| New Alloy | Cu | Mg | V | Mn | TYS (L) | UPE (L-T) |
| 1 | 3.52 | 0.98 | 0.14 | 0.28 | 475 | 247.8 |
| 2 | 3.42 | 0.99 | 0.11 | 0.29 | 465 | 232.5 |
| 3 | 3.38 | 1.22 | 0.11 | 0.28 | 477 | 203.6 |
| 4 | 3.5 | 0.98 | 0.11 | 0.29 | 472 | 205.0 |
| 5 | 3.46 | 0.97 | 0.068 | 0.29 | 467 | 202.5 |
| 6 | 3.41 | 0.96 | 0.03 | 0.29 | 466 | 202.5 |
| 7 | 4.04 | 0.82 | 0.11 | 0.28 | 500 | 184.7 |
| 8 | 3.84 | 0.99 | 0.11 | 0.29 | 495 | 166.3 |
| 9 | 3.47 | 0.97 | 0.11 | 0.051 | 472 | 171.6 |
| 10 | 3.53 | 0.98 | 0.11 | 0.6 | 489 | 164.8 |
| 11 | 4.06 | 0.95 | 0.11 | 0.3 | 506 | 158 |

TABLE 5

| Composition and properties of comparison alloys | | | | | | |
|---|---|---|---|---|---|---|
| Comparison Alloy | Cu | Mg | V | Mn | TYS (L) | UPE (L-T) |
| 12 | 3.41 | 0.95 | 0.11 | 0.29 | 451 | 189.9 |
| 13 | 3.54 | 0.5 | 0.11 | 0.28 | 423 | 224.8 |
| 14 | 3.83 | 1.07 | 0 | 0.33 | 498 | 115.7 |
| 15 | 3.48 | 0.98 | 0.18 | 0.3 | 463 | 151.7 |
| 16 | 2.92 | 0.82 | 0.11 | 0.28 | 391 | 284.8 |
| 17 | 3.86 | 0.6 | 0.11 | 0.28 | 450 | 201.6 |
| 18 | 4.24 | 0.96 | 0.11 | 0.3 | 505 | 120 |
| 19 | 3.48 | 1.4 | 0.1 | 0.3 | 491 | 139 |
| 20 | 3.55 | 1.62 | 0.1 | 0.3 | 488 | 102 |
| 21 | 3.5 | 0.95 | 0.12 | 0.82 | 469 | 109 |
| 22 | 3.57 | 0.96 | 0.1 | 1.02 | 449 | 146 |
| 23 | 3.49 | 0.96 | 0.18 | 0.3 | 473 | 104 |
| 24 | 3.58 | 0.98 | 0.22 | 0.31 | 450 | 163 |
| 25 | 3.43 | 0.93 | 0.001 | 0.3 | 451 | 162 |
| AA2027 | 4.43 | 1.26 | 0 | 0.87 | 539 | 106 |
| AA2027 + V | 4.24 | 1.23 | 0.11 | 0.84 | 531 | 61 |
| AA2139 | 4.74 | 0.44 | 0.002 | 0.26 | 481 | 147 |

FIG. 1 illustrates the tensile yield strength (TYS) versus unit propagation energy (UPE) results for the alloys. As illustrated, the new alloys achieve an improved combination of strength and toughness over the comparison and prior art alloys. As illustrated by Line Z-Z, all new alloys have a strength to toughness combination that satisfies the expression FT≥456-0.611*TYS at a minimum tensile yield strength of 460 MPa, where FT is the unit propagation energy in $KJ/m^2$ of the alloy as measured in accordance with ASTM B871, as provided above, and where TYS is the longitudinal tensile yield strength of the alloy in MPa as measured in accordance with ASTM E8 and B557. The typical performance level of the new alloy in a T89 temper may lie at or above line Y-Y, which has the same equation as line Z-Z, except that the intercept of the line expression has a value of about 485 instead of about 456.

The new alloys achieve these improved properties due, at least in part, to their unique and synergistic combination of elements. For example, when the amount of copper in the alloy goes below about 3.1 wt. % or exceeds about 4.1 wt. %, the alloy may not realize an improved combination of properties. As provided above, all new alloys contain copper in the range of from about 3.1 wt. % to about 4.1 wt. %. Comparison alloys 16 and 18 highlight the effect of utilizing alloys having Cu outside this range. Comparison alloys 16 and 18 include Mg, Mn, and V all within the composition of the new alloys. However, comparison alloy 16 includes only 2.92 wt. % Cu, while comparison alloy 18 includes 4.24 wt. % Cu. As illustrated in FIG. 2, alloy 16 experiences a marked decrease in strength over alloys having at least about 3.1 wt. % Cu. Alloy 18 experiences a marked decrease in toughness over alloys having not greater than about 4.1 wt. % Cu.

With respect to magnesium, when the amount of magnesium in the alloy goes below about 0.7 wt. % or exceeds about 1.3 wt. % Mg, the alloy may not realize an improved combination of properties. As provided above, all new alloys contain magnesium in the range of from about 0.7 wt. % to about 1.3 wt. % Mg. Comparison alloys 13, 17, 19 and 20 highlight the effect of utilizing alloys having Mg outside this range. Comparison alloys 13, 17, 19, and 20 include Cu, Mn, and V all within the composition of the new alloys. However, comparison alloys 13 and 17 include low amounts of Mg, comparison alloy 13 having 0.5 wt. % Mg and comparison alloy 17 having 0.6 wt. % Mg. Comparison alloys 19 and 20 include high amounts of Mg, comparison alloy 19 having 1.4 wt. % Mg and comparison alloy 20 having 1.62 wt. % Mg. As illustrated in FIG. 3, alloys 13 and 17 experience a marked decrease in strength over alloys having at least about 0.7 wt. % Mg. Alloys 19 and 20 experience a marked decrease in toughness over alloys having not greater than about 1.3 wt. % Mg.

With respect to manganese, when the amount of manganese in the alloy goes below about 0.01 wt. % or exceeds about 0.7 wt. % Mn, the alloy may not realize an improved combination of properties. As provided above, all new alloys contain manganese in the range of from about 0.01 wt. % to about 0.6 wt. % Mn. Comparison alloys 21 and 22 highlight the effect of utilizing alloys having high amounts of Mn. Comparison alloys 21 and 22 include Cu, Mg, and V all within the composition of the new alloys. However, comparison alloy 21 includes 0.82 wt. % Mn, and comparison alloy 22 includes 1.02 wt. % Mn. As illustrated in FIG. 4, alloys 21 and 22 experience a marked decrease in toughness over alloys having not greater than about 0.7 wt. % Mn. Similarly, it is expected, based on the performance trend relative to the new alloys having about 0.3 wt. % Mn and the new alloys having about 0.05 wt. % Mn, that alloys containing less than 0.01 wt. % Mn would not realize the improved combination of properties. For example, new alloy 9 contains 0.05 wt. % Mn and achieves an improved combination of strength and toughness but the improvement is less than the alloys containing about 0.29 wt % Mn. Therefore, alloys that contain less than about 0.01 wt. % Mn may not realize an improved combination of properties.

With respect to vanadium, when the amount of vanadium in the alloy goes below about 0.01 wt. % or exceeds about 0.16 wt. % V, the alloy may not realize an improved combination of properties. As provided above, all new alloys contain vanadium in the range of from about 0.01 wt. % to about 0.16 wt. % V. Comparison alloys 14, 15, 23, 24, and 25 highlight the effect of utilizing alloys having V outside this range. Comparison alloys 14, 15, 23, 24 and 25, include Cu, Mg, and Mn all within the composition of the new alloys. However, comparison alloys 14 and 25 include substantially no V, with those alloys having not greater than 0.001 wt. % V. As illustrated in FIG. 5, alloys 14 and 25 experience a marked decrease in toughness over alloys having at least about 0.01 wt. % V. Comparison alloys 15, 23, and 24 include high amounts of V, comparison alloys 15 and 23 having 0.18 wt. % V and comparison alloy 24 having 0.22 wt. % V. Alloys 15, 23, and 24 experience a marked decrease in strength and/or toughness over alloys having not greater than about 0.16 wt. % V.

The grain structure control elements may also play a role in achieving improved properties. For example, alloys containing Cu, Mg, Mn and V within the above described ranges of Table 1, and also containing a least 0.05 wt. % Zr, achieved an improved combination of strength and toughness, as illustrated in Tables 2 and 4, and FIG. 1. However, comparison alloy 12, which contains not greater than 0.001 wt. % Zr, but contained Cu, Mg, Mn and V within the above described ranges of Table 1, did not realize the improved combination of properties. Therefore, alloys that contain less than about 0.01 wt. % of a grain structure control element may not realize an improved combination of properties.

The total amount of copper and magnesium (Cu+Mg) in the alloy may also be related to alloy performance. For example, in some embodiments, when the total amount of Cu+Mg goes below about 4.1 wt. % or exceeds about 5.1 wt. %, the alloy may not realize an improved combination of properties. As provided above, all new alloys contain Cu+Mg in the range of from about 4.1 wt. % to about 5.1 wt. %. Comparison alloys 16, 18 and 20 highlight the effect of utilizing alloys having Cu+Mg outside this range. As illustrated above, comparison alloy 16 has low Cu+Mg at 3.74 wt. % and realizes low strength. Comparison alloys 18 and 20 have high Cu+Mg at 5.2 wt. % and 5.17 wt. %, respectively. Comparison alloys 18 and 20 both have low fracture toughness.

The copper-to-magnesium ratio (the Cu/Mg ratio) of the alloy may also be related to alloy performance. For example, in some embodiments, when the Cu/Mg ratio goes below about 2.6 or exceeds about 5.5, the alloy may not realize an improved combination of properties. As provided above, all new alloys have a Cu/Mg ratio in the range of from about 2.6 to about 5.5. Comparison alloys 13, 17, and 19 highlight the effect of utilizing alloys having the Cu/Mg ratio outside this range. As illustrated above, comparison alloy 19 has low a Cu/Mg ratio at 2.5 and realizes low fracture toughness. Comparison alloys 13 and 17 have high Cu/Mg ratios at 7.1 and 6.4, respectively. Comparison alloys 13 and 17 both have low strength.

Example 2

Additional Testing of New Alloy in T89 Temper

Alloy Preparation

Rectangular ingots of the size 6"×16" are cast, one of the new alloy, and three comparison alloys, as provided in Table 6, below (all values in wt. %).

TABLE 6

Composition of new alloy (26) and comparison alloys (27-29)

| Alloy | Cu | Mg | V | Mn | Ag | Balance |
|---|---|---|---|---|---|---|
| 26 | 3.66 | 0.88 | 0.12 | 0.28 | 0.02 | Aluminum, grain structure |
| 27 | 3.58 | 0.92 | 0 | 0.27 | 0 | control elements, optional |
| 28 | 3.60 | 0.94 | 0 | 0.29 | 0.48 | incidental elements |
| 29 | 5.01 | 0.49 | 0.11 | 0.29 | 0 | and impurities |

Alloy 26 is the new alloy, and alloys 27-29 are comparison alloys having at least one element outside the composition of the new alloy. For example, comparison alloy 27 contains no vanadium. Comparison alloy 28 contains no vanadium, but contains silver. Comparison alloy 29 contains a high amount of copper and low magnesium.

All ingots are homogenized using the following practice:

Heat up in 16 hours to 910° F.

Soak at 910° F. for 4 hours,

Ramp in 1 hr to 940° F.,

Soak at 940° F. for 8 hours

Ramp in 2 hours to 970° F.,

Soak at 970° F. for 24 hours

Air cooling

The surfaces of the homogenized ingots are then scalped (~0.25 to 0.5" from each surface), after which the ingots are heated to 940° F. and then hot rolled at ~900° F. The ingots are broadened to about 23" and then straight rolled to 0.75" gauge. During hot rolling, the slab is reheated to 940° F. if the temperature drops below 750° F. The hot rolled product is then solution heat treated at 970° F. for 1 hr and cold water quenched. The product is then cold rolled to 0.675" (about a 10% reduction) within 2 hours after quenching. The alloys are then naturally aged for at least 96 hours at room temperature, and are then artificially aged at about 310° F. for about 48 hours to achieve peak strength and a T89 temper.

Strength and Toughness Testing

After aging, all alloys are subjected to tensile tests, including tensile yield strength (TYS) tests, in accordance with ASTM E8 and B557, in the longitudinal (L) and long transverse (LT) orientation. The fracture toughness, $K_Q$, in the L-T orientation is determined in accordance with ASTM E399 and ASTM B645. The specimen width (W) is 3 inches and the thickness (B) is full plate thickness (0.675 inch). The plane stress fracture toughness $K_{app}$, in the L-T orientation is determined in accordance with ASTM E561 and ASTM B646. The specimen width (W) is 16 inches, the thickness (B) is 0.25 inch and the initial crack length ($2a_o$) is 4 inches. The results of these tests are provided in Table 7 below.

TABLE 7

Strength and toughness of new alloy (26) and comparison alloys (27-29) in T89 Temper

| | L Tensile | | | LT Tensile | | | L-T Toughness | |
|---|---|---|---|---|---|---|---|---|
| Alloy | TYS (MPa) | UTS (MPa) | Elong (%) | TYS (MPa) | UTS (MPa) | Elong (%) | $K_Q$ (MPa√m) | $K_{app}$ (MPa√m) |
| 26 | 484 | 513 | 14 | 496 | 523 | 12 | 57.8 | 135 |
| 27 | 481 | 512 | 15 | 472 | 511 | 14 | 51.3 | 113 |
| 28 | 501 | 524 | 13 | 490 | 523 | 13 | 52.3 | 132 |
| 29 | 473 | 508 | 14 | 471 | 514 | 12 | 44.8 | 118 |

All reported tensile values are an average of the measurement of three specimens, $K_Q$ values are an average of two specimens, and $K_{app}$ values from a single specimen. Those skilled in the art will appreciate that the numerical values of $K_Q$ and $K_{app}$ are influenced by specimen width, thickness, initial crack length and test specimen geometry. Thus, $K_Q$ and $K_{app}$ can only be reliably compared from test specimens of equivalent geometry, width, thickness and initial crack length.

FIG. 6 illustrates the tensile yield strength (TYS) versus the $K_Q$ fracture toughness, and FIG. 7 illustrates the TYS versus the $K_{app}$ fracture toughness. New alloy 26 containing 0.12 wt. % V exhibits the highest $K_Q$ and $K_{app}$. The improvement in $K_Q$ and $K_{app}$ over comparison alloy 27, which has no vanadium, is about 13% for $K_Q$ and about 19% for $K_{app}$, respectively.

Comparison alloy 28 also has no vanadium, but includes 0.48 wt. % Ag and realizes a higher $K_Q$, $K_{app}$ and TYS than comparison alloy 27, indicating beneficial effects may be realized with Ag additions. However, compared to new alloy 26, comparison alloy 28 has a $K_Q$ and a Kapp that are 9% and 2% less, respectively, than new alloy 26, and its combination of strength and toughness is inferior to that of new alloy 26.

Comparison alloy 29 contains 0.11 wt. % V, but has a high amount of copper (5.01 wt. %) and a low amount of magnesium (0.49 wt. %). Comparison alloy 29 exhibits the lowest $K_Q$ and second lowest Kapp value—22% less and 13% less, respectively than new alloy 26.

These results illustrate that the amount of copper, magnesium and vanadium play a role in achieving high fracture toughness. The results also illustrate that Ag additions may have a beneficial effect on fracture toughness, but also indicate that the percentage addition of vanadium required to achieve the toughness improvements is much less than the percentage addition of Ag needed. This is an important finding as the cost of Ag is significantly higher than the cost of V. However, Ag additions in addition to V additions may still be desirable for other reasons, such as corrosion resistance.

Spectrum Fatigue Crack Growth Resistance

The spectrum fatigue crack growth resistance of new alloy 26 and comparison alloys 27-29 is measured in accordance with an aircraft manufacture specification. The specimen is a center-cracked M(T) specimen in the L-T orientation having a width of 200 mm (7.87 in.) and thickness of 12 mm (0.47 in.). Prior to the application of the spectrum to the M(T) specimens, the specimens are fatigue pre-cracked under constant amplitude loading condition to a half crack length (a) of about 20 mm. Collection of crack growth data under spectrum loading starts at a half crack length of 25 mm to reduce the influence of transient effects resulting from the change from constant amplitude to spectrum loading conditions. The spectrum crack growth data is collected over the crack length interval of 25-65 mm, and crack length vs. number of simulated flights and the number of flights to reach 65 mm are obtained. The test frequency is about 10 Hz, and the tests are performed in a moist air environment having a relative humidity of greater than about 90%. FIG. 8 shows the crack length versus the number of simulated plots and Table 8 the number of flights to reach 65 mm.

TABLE 8

Spectrum FCG life of new alloy (26) and comparison alloys (27-29) in a T89 temper

| Alloy | No. of Flights |
|---|---|
| 26 | 6951 |
| 27 | 5431 |
| 28 | 6381 |
| 29 | 4144 |

New alloy 26 has the longest spectrum life. The improvement in life over comparison alloy 27, which has no V, is 28%. The performance of comparison alloy 28 is similar to new alloy 26, indicating that Ag may have a beneficial effect, but is still 8% less than new alloy 26. Comparison alloy 29 has the lowest spectrum life, about 40% less than new alloy 26. These results illustrate the beneficial effects of the composition of the new alloys relative to spectrum fatigue crack growth resistance.

Constant Amplitude Fatigue Crack Growth Resistance

The constant amplitude fatigue crack growth resistance of specimens of new alloy 26 and comparison alloys 27-29 is measured in accordance with ASTM E647 in the L-T orientation. The test specimens are M(T) specimens having a width (W) of 4" and thickness (B) of 0.25" The tests are K-increasing tests with a normalized K-gradient C=0.69/mm, an initial crack length ($2a_o$) of 5 mm and initial ΔK of 4.9 MPa√m. The stress ratio ($P_{min}/P_{max}$) is 0.1. The tests are performed at a frequency of 25 Hz in a moist air environment having a relative humidity of at least about 90%. The test data are analyzed in accordance with the incremental polynomial method in ASTM E647 to obtain the fatigue crack growth rate (da/dN) as a function of the stress intensity factor range (ΔK).

FIG. 9 illustrates da/dN versus ΔK generated from the test data for each of the Table 6 alloys. New alloy 26 exhibits slower rate of crack growth over a large portion of the ΔK range compared to comparison alloy 27, which has no vanadium. The performance of comparison alloy 28 is similar to new alloy 26, indicating again that Ag may have a beneficial effect. Comparison alloy 29 exhibits good fatigue crack growth performance, but, considering all mechanical properties, is the poorest performing of all alloys of Table 6.

Corrosion Performance of New Alloy

An alloy having a composition within the range of Table 1 is prepared in a T89 temper, as described above, and is tested for exfoliation corrosion resistance. ASTM G110 is used to evaluate general corrosion resistance of the alloy. Review of optical micrographs of the alloy at the T/10 plane after 6-hr immersion in the 3.5% $NaCl+H_2O_2$ solution indicate that the corrosion attack mode of the alloy is pitting (P) and intergranular (IG) corrosion. The alloy is also tested for exfoliation corrosion resistance (EXCO) at the T/10 plane in accordance with ASTM G34. After 96 hours of exposure, the alloy realizes an EXCO rating of EC. The alloy is also tested for stress corrosion cracking resistance in the long transverse (LT) direction in accordance with ASTM G44 and G47. A ⅛" diameter, 2" long tensile bar with a double shoulder is used for the test. The stress level of the test is 250 MPa. The alloy passes the standard 40 day exposure period for the LT orientation, and even exceeds 120 days with no failures.

Example 3

Performance of New Alloy in Naturally Aged Temper (39)

The alloys of Table 6 are prepared as in Example 2, except that they are naturally aged to the T39 temper without being subjected to any artificial aging step. Tensile strength is measured in the L and LT directions, and the fracture toughness, $K_Q$, is measured in the L-T orientation. The test specimen geometry and dimensions are the same as in Example 2. The results of these tests are provided in Table 9, below. All reported tensile values are an average of the measurement of three specimens, and $K_Q$ values are an average of two specimens.

TABLE 9

Strenght and toughness of new alloy (26) and comparison alloys (27-29) in the T39 temper

| | L Tensile | | | LT Tensile | | | L-T Toughness |
|---|---|---|---|---|---|---|---|
| Alloy | TYS (MPa) | UTS (MPa) | Elong (%) | TYS (MPa) | UTS (MPa) | Elong (%) | $K_Q$ (MPa√m) |
| 26 | 400 | 469 | 10 | 380 | 474 | 14 | 52.1 |
| 27 | 403 | 476 | 12 | 369 | 474 | 16 | 49.1 |
| 28 | 399 | 483 | 14 | 372 | 485 | 16 | 54.2 |
| 29 | 390 | 462 | 14 | 366 | 464 | 14 | 51.1 |

The strength of the new alloy 26 with vanadium (0.12 wt. %) and the comparison alloy 27 without vanadium is similar, but the $K_Q$ (toughness) of the new alloy is improved 6%. Comparison alloy 29, containing vanadium (0.11 wt. %) but high copper (5.01 wt. %) and low magnesium (0.49 wt. %) exhibits both lower strength and lower fracture toughness. Comparison alloy 28, containing no vanadium, but 0.48 wt. % silver, exhibits similar tensile yield strength (TYS) to new alloy 26, but higher ultimate tensile strength (UTS) and $K_Q$ (toughness), again illustrating the efficacy of Ag in improving mechanical properties. However, the level of costly Ag additions resulting in the above improvement (i.e., 0.48 wt. %) was significantly higher than the level of vanadium required to achieve similar results.

Example 4

Evaluation of ≈1" Plate in Various Tempers

An embodiment of a new 2xxx alloy containing vanadium (30), as well as a comparative 2xxx alloy (31), are produced in various tempers by homogenizing, hot rolling, solution heat treating, quenching, cold working, stretching and natural aging (for the T3 tempers) or artificial aging (for the T89 temper). The microstructure is a partially recrystallized microstructure. The final gauge of the products is about 1 inch (about 25.4 mm). Table 10 provides the composition of the new alloy (30) and the comparative alloy, as well as the composition of similar prior art alloys 2027 and 2624.

TABLE 10

Composition of Alloys

| Alloy | Cu | Mg | V | Mn | Ag | Balance |
|---|---|---|---|---|---|---|
| 30 | 3.66 | 0.96 | 0.66 | 0.27 | — | Aluminum, grain |
| 31 | 4.18 | 1.4 | 0.003 | 0.65 | — | structure control |
| 2027 | 3.9-4.9 | 1.0-1.5 | — | 0.5-1.2 | — | elements, optional |
| 2624 | 3.8-4.3 | 1.2-1.6 | — | 0.45-0.7 | — | incidental elements and impurities |

The tensile properties of alloys 30 and 31 are measured in accordance with ASTM B557, and the plane stress fracture toughness of alloys 30 and 31 is measured in accordance with ASTM E561 and ASTM B646. For the toughness tests, the specimen width is 16 inches, the thickness is 0.25 inch, and the initial crack length ($2a_o$) is 4 inches. Alloy 30 in the T39 and T89 condition achieves an improved combination of properties over alloy 31 as illustrated in Table 11, below.

TABLE 11

Mechanical Properties of Alloys

| | Plate Dimensions | | L Tensile (T/2) | | | L-T FT (T/2) |
|---|---|---|---|---|---|---|
| Alloy | Thickness (mm) | Width (m) | TYS (MPa) | UTS (MPa) | Elong (%) | $K_{app}$ (MPa√m) |
| 30-T351 | 26.9 | 2.438 | 359.0 | 445.8 | 20.5 | 112.4 |
| 30-T39 | 30.0 | | 431.5 | 473.0 | 14.0 | 123.4 |
| 30-T89 | 26.9 | | 460.3 | 486.5 | 16.3 | 133.4 |
| 31-T351 | 26.9 | 2.438 | 412.5 | 503.3 | 17.5 | 117.8 |
| 31-T39 | 27.9 | | 482.5 | 518.8 | 12.0 | 112.1 |

As illustrated in FIGS. 10 and 11, the new alloy (30) in the T39 and T89 tempers achieves a better combination of strength and toughness than the comparable alloy (31), as well as the estimated typical properties for similar prior art alloys 2027 and 2624. Alloy 30 in the T39 and T89 tempers realizes a strength-to-toughness combination that satisfies the expression FT≥146.1−0.062*TYS at a minimum tensile yield strength of 300 MPa, as illustrated by line A-A, where FT is the plane stress fracture toughness in $K_{app}$ as measured in accordance with ASTM E561 and ASTM B646, using the specimen size and initial crack length described above, and where TYS is the longitudinal tensile yield strength of the alloy in MPa as measured in accordance with ASTM E8 and B557. The typical performance levels of the new alloy in a T39 temper may lie on or above line B-B, which has the same equation as line A-A, except that the intercept of the line expression has a value of about 149.5 instead of about 146.1. The typical performance levels of the new alloy in a T89 temper may lie on or above line C-C, which has the same equation as line A-A, except that the intercept of the line expression has a value of about 161 instead of about 146.1.

In some embodiments, the new alloy compositions disclosed herein may provide high damage tolerance in thin plate (e.g., from about 0.25 or 0.5" to about 1.5" or about 2" in thickness) resulting from its enhanced, combined fracture toughness, yield strength and/or fatigue crack growth resistance properties. Resistance to cracking by fatigue is a desirable property. The fatigue cracking referred to occurs as a result of repeated loading and unloading cycles, or cycling between a high and a low load such as when a wing moves up and down. This cycling in load can occur during flight due to gusts or other sudden changes in air pressure, or on the ground while the aircraft is taxing. Fatigue failures account for a large percentage of failures in aircraft components. These failures are insidious because they can occur under normal operating conditions, without excessive overloads, and without warning.

If a crack or crack-like defect exists in a structure, repeated cyclic or fatigue loading can cause the crack to grow. This is referred to as fatigue crack propagation. Propagation of a crack by fatigue may lead to a crack large enough to propagate catastrophically when the combination of crack size and loads are sufficient to exceed the material's fracture toughness. Thus, performance in the resistance of a material to crack propagation by fatigue offers substantial benefits to longevity of aerospace structures. The slower a crack propagates, the better. A rapidly propagating crack in an airplane structural member can lead to catastrophic failure without adequate time for detection, whereas a slowly propagating crack allows time for detection and corrective action or repair. Hence, a low fatigue crack growth rate is a desirable property.

When the geometry of a structural component is such that it does not deform plastically through the thickness when a tension load is applied (plane-strain deformation), fracture toughness is often measured as plane-strain fracture toughness, $K_{Ic}$. This normally applies to relatively thick products or sections, for instance 0.6 or 0.75 or 1 inch, or more. The ASTM has established a standard test using a fatigue pre-cracked compact tension specimen to measure $K_{Ic}$ (ASTM E399), which has the units ksi√in or MPa√m. This test is usually used to measure fracture toughness when the material is thick because it is believed to be independent of specimen geometry, as long as appropriate standards for width, crack length and thickness are met. The symbol K, as used in $K_{Ic}$, is referred to as the stress intensity factor. With respect to some of the property values reported herein, $K_Q$ values were obtained, instead of KIc values, due to the dimensional constraints of the material. To obtain valid plane-strain $K_{Ic}$ results, a thicker and wider specimen would have been required. However, they are still indicative of the higher toughness of the new alloys, in general, since the data between varying alloy compositions were obtained using results from specimens of the same size and under similar test conditions. A valid $K_{Ic}$ is generally considered a material property relatively independent of specimen size and geometry. $K_Q$, on the other hand, may not be a true material property in the strictest academic sense because it can vary with specimen size and geometry. Typical $K_Q$ values from specimens smaller than needed are conservative with respect to $K_{Ic}$, however. In other words, reported fracture toughness ($K_Q$) values are generally lower than standard $K_{Ic}$ values obtained when the sample size related, validity criteria of ASTM Standard E399 are satisfied.

When the geometry of the alloy product or structural component is such that it permits deformation plastically through its thickness when a tension load is applied, fracture toughness is often measured as plane-stress fracture toughness. This fracture toughness measure uses the maximum load generated on a relatively thin, wide pre-cracked specimen. When the crack length at the maximum load is used to calculate the stress-intensity factor at that load, the stress-intensity factor is referred to as plane-stress fracture toughness $K_c$. When the stress-intensity factor is calculated using the crack length before the load is applied, however, the result of the calculation is known as the apparent fracture toughness, $K_{app}$, of the material. Because the crack length in the calculation of $K_c$ is usually longer, values for $K_c$ are usually higher than $K_{app}$ for a given material. Both of these measures of fracture toughness are expressed in the units ksi√in or MPa√m. For tough materials, the numerical values generated by such tests generally increase as the width of the specimen increases or its thickness decreases. It is to be appreciated that the width of the test panel used in a toughness test can have a substantial influence on the stress intensity measured in the test. A given material may exhibit a $K_{app}$ toughness of 60 ksi√in using a 6-inch wide test specimen, whereas the measured $K_{app}$ will increase with wider specimens. For instance, the same material that realizes a plane stress toughness of 60 ksi√in ($K_{app}$) with a 6-inch panel could exhibit a higher $K_{app}$ using a 16-inch wide panel, (e.g., around 90 ksi√in), still higher using a 48-inch wide panel (e.g., around 150 ksi√in), and a still higher using a 60-inch wide panel (e.g., around 180 ksi√in) as the test specimen. Accordingly, in referring to K values for the plane stress toughness tests herein, unless indicated otherwise, such refers to testing with a 16-inch wide panel. However, those skilled in the art recognize that test results can vary depending on the test panel width and it is intended to encompass all such tests in referring to toughness. Hence, toughness substantially equivalent to or substantially corresponding to a minimum value for $K_c$ or $K_{app}$ in characterizing the new alloy products, while largely referring to a test with a 16-inch panel, is intended to embrace variations in $K_c$ or $K_{app}$ encountered in using different width panels as those skilled in the art will appreciate. The plane-stress fracture toughness ($K_{app}$) test applies to all thicknesses of products, but may in some applications find more use in thinner products such as 1 inch or ¾ inch or less in thickness, for example, ⅝ inch or ½ inch or less in thickness.

While the majority of the instant disclosure has been presented in terms of rolled products, i.e., sheet and plate, it is expected that similar improvements will be realized with the instantly disclosed alloy in other wrought product forms, such as extrusions and forgings. Moreover, while specific embodiments of the instant disclosure has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the instant disclosure which is to be given the full breadth of the appended claims and any and all equivalents thereof.

What is claimed is:

1. A method comprising:

(a) preparing an aluminum alloy product consisting of:

3.3 to 4.1 wt. % Cu;

0.7 to 1.3 wt. % Mg;

0.01 to 0.16 wt. % V;

0.05 to 0.6 wt. % Mn;

0.05 to 0.20 wt. % Zr; and up to 0.6 wt. % Ag;

the balance being aluminum, incidental elements, and impurities;

wherein the combined amount of copper and magnesium is in the range of from 4.0 wt. % to 5.1 wt. %;

wherein the ratio of copper to magnesium is in the range of from 2 to 5.5 and (b) processing the aluminum alloy product into one of a T3 or T8 temper.

2. The method of claim 1, wherein the processing comprises:

solution-heat treating and quenching the aluminum alloy product; and cold working the aluminum alloy product.

3. The method of claim 2, comprising, after the cold working, naturally aging the aluminum alloy product to a T3 temper.

4. The method of claim 3, wherein the T3 temper is selected from the group consisting of T39, T351, and T36.

5. The method of claim 2, comprising, after the cold working, artificially aging the aluminum alloy product to a T8 temper.

6. The method of claim 5, wherein the T8 temper is selected from the group consisting of T89, T851 and T86.

7. The method of claim 1, wherein the preparing comprises at least one of rolling, extruding and forging.

8. The method of claim 1, comprising:

forming the aluminum alloy product into an aerospace structural member.

9. The method of claim 8, wherein the aerospace structural member is selected from the group consisting of an aircraft fuselage skin, an aircraft fuselage panel, a lower wing skin, a horizontal stabilizer, a pressure bulkhead, and a fuselage reinforcement.

10. The method of claim 1, comprising:

forming the aluminum alloy product into a drill pipe.

11. The method of claim 1, comprising:

forming the aluminum alloy product into a drill riser.

12. The method of claim 1, wherein the aluminum alloy product includes:

3.3 to 3.9 wt. % Cu;

0.8 to 1.2 wt. % Mg;

0.05 to 0.16 wt. % V;

0.1 to 0.5 wt. % Mn; and 0.08 to 0.18 wt. % Zr.

13. The method of claim 12, wherein the aluminum alloy product includes:

3.4 to 3.7 wt. % Cu;

0.9 to 1.1 wt. % Mg;

0.07 to 0.15 wt. % V;

0.2 to 0.4 wt. % Mn; and 0.08 to 0.15 wt. % Zr.

14. The method of claim 13, wherein the alloy includes at least 0.09 wt. % V.

15. The method of claim 13, wherein the impurities include one or more of Fe, Si and Zn, and wherein the aluminum alloy product includes not greater than 0.15 wt. % Fe, not greater than 0.10 wt. % Si, and not greater than 0.25 wt. % Zn.

16. The method of claim 14, wherein the impurities include one or more of Fe, Si and Zn, and wherein the aluminum alloy product includes not greater than 0.05 wt. % Fe, not greater than 0.03 wt. % Si, and not greater than 0.25 wt. % Zn.

17. The method of claim 15, wherein the aluminum alloy product is substantially free of Ag.

18. The method of claim 16, wherein the aluminum alloy product is substantially free of Ag.

19. The method of claim 15, wherein the ratio of copper to magnesium is in the range of from 3.25 to 4.5.

20. The method of claim 18, wherein the ratio of copper to magnesium is in the range of from 3.25 to 4.5.

* * * * *

UNITED STATES PATENT AND TRADEMARK OFFICE

CERTIFICATE OF CORRECTION

PATENT NO. : 8,764,920 B2
APPLICATION NO. : 13/610755
DATED : July 1, 2014
INVENTOR(S) : Lin et al.

It is certified that error appears in the above-identified patent and that said Letters Patent is hereby corrected as shown below:

In the Claims

In Column 19, line 35, Claim 1, delete "from 2 to 5.5" and insert --from 2.6 to 5.5--.

Signed and Sealed this
Fifteenth Day of September, 2015

Michelle K. Lee

Michelle K. Lee
*Director of the United States Patent and Trademark Office*